US008326176B2

(12) United States Patent
Takayama

(10) Patent No.: US 8,326,176 B2
(45) Date of Patent: Dec. 4, 2012

(54) ELECTROPHOTOGRAPHIC IMAGE FORMING APPARATUS AND SUPPORTING MEMBER

(75) Inventor: Akinori Takayama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 420 days.

(21) Appl. No.: 12/619,098

(22) Filed: Nov. 16, 2009

(65) Prior Publication Data

US 2010/0124432 A1 May 20, 2010

(30) Foreign Application Priority Data

Nov. 19, 2008 (JP) ..... 2008-296014

(51) Int. Cl.
*G03G 15/00* (2006.01)
*G03G 15/02* (2006.01)

(52) U.S. Cl. ..... 399/110; 399/116; 399/117

(58) Field of Classification Search ..... 399/329, 399/110, 116, 117
See application file for complete search history.

(56) References Cited

U.S. PATENT DOCUMENTS

| | | | | |
|---|---|---|---|---|
| 5,445,451 | A * | 8/1995 | Harmony | 312/333 |
| 5,608,498 | A | 3/1997 | Nagase et al. | 399/130 |
| 5,926,671 | A * | 7/1999 | Leibman | 399/110 |
| 6,708,011 | B2 | 3/2004 | Nomura et al. | 399/110 |
| 6,996,354 | B2 * | 2/2006 | Kimura et al. | 399/121 |
| 7,155,141 | B2 * | 12/2006 | Sato et al. | 399/114 |
| 7,184,688 | B2 * | 2/2007 | Ishii | 399/113 |
| 7,184,689 | B2 * | 2/2007 | Kang et al. | 399/114 |
| 2002/0031369 | A1 * | 3/2002 | Tokutake et al. | 399/110 |
| 2003/0053819 | A1 * | 3/2003 | Nomura et al. | 399/110 |
| 2006/0051127 | A1 * | 3/2006 | Kang et al. | 399/114 |
| 2006/0067734 | A1 * | 3/2006 | Igarashi et al. | 399/119 |
| 2007/0071494 | A1 | 3/2007 | Igarashi et al. | 399/110 |
| 2007/0160380 | A1 * | 7/2007 | Imaizumi et al. | 399/90 |
| 2007/0160384 | A1 * | 7/2007 | Sakurai et al. | 399/110 |
| 2007/0160385 | A1 * | 7/2007 | Noguchi et al. | 399/110 |
| 2007/0160388 | A1 * | 7/2007 | Yoshimura et al. | 399/111 |
| 2008/0159773 | A1 | 7/2008 | Murayama et al. | 399/90 |
| 2008/0159774 | A1 * | 7/2008 | Tanabe et al. | 399/90 |
| 2008/0159781 | A1 * | 7/2008 | Noguchi et al. | 399/110 |
| 2008/0292355 | A1 * | 11/2008 | Sakurai et al. | 399/110 |
| 2009/0047039 | A1 * | 2/2009 | Noguchi et al. | 399/116 |
| 2009/0092412 | A1 * | 4/2009 | Kei | 399/110 |
| 2009/0129812 | A1 * | 5/2009 | Kawanami et al. | 399/111 |
| 2009/0269100 | A1 * | 10/2009 | Hashimoto | 399/114 |
| 2010/0067947 | A1 * | 3/2010 | Yuzawa | 399/119 |
| 2010/0080615 | A1 * | 4/2010 | Kikuchi | 399/111 |
| 2010/0098452 | A1 * | 4/2010 | Inaba | 399/92 |
| 2010/0098457 | A1 * | 4/2010 | Watanabe | 399/111 |

* cited by examiner

*Primary Examiner* — Walter L Lindsay, Jr.
*Assistant Examiner* — David Bolduc
(74) *Attorney, Agent, or Firm* — Fitzpatrick, Cella, Harper & Scinto

(57) ABSTRACT

An electrophotographic image forming apparatus includes an electrophotographic image forming apparatus main assembly, with the main assembly including a preventing portion. The apparatus also includes a supporting member for supporting a plurality of electrophotographic photosensitive members, with the supporting member being movable between an inside position inside the main assembly, and an outside position outside the main assembly in a state in which the supporting member is supported by the main assembly and being disengageable from the main assembly at the outside position. A handle portion is provided to the supporting member, to be touched for disengaging the supporting member from the main assembly, with the handle portion being provided upstream of the plurality of electrophotographic photosensitive members with respect to a movement direction in which the supporting member is moved from the inside position to the outside position.

25 Claims, 16 Drawing Sheets

ELECTROPHOTOGRAPHIC IMAGE FORMING APPARATUS AND SUPPORTING MEMBER

FIELD OF THE INVENTION AND RELATED ART

The present invention relates to an electrophotographic image forming apparatus having the function of forming an image on a recording material (medium) such as a sheet. The image forming apparatus includes, e.g., a copying machine, a printer, and the like.

As an exchanging method of a cartridge with respect to an apparatus main assembly of the image forming apparatus, U.S. Pat. No. 5,608,498 discloses the following constitution. That is, a cartridge is supported through a guide member capable of elongating and contracting in two steps with respect to an ascending/descending board which is moved forward and backward and up and down in interrelation with a side surface cover. The cover is opened to raise and move the cartridge 30 from an image forming position to a pulled-out position, and then the cartridge is directly pulled out. By the pulling-out, the cartridge is optionally moved to a position including a stopping position so as to perform mounting/demounting of each device and jammed paper clearance.

Further, U.S. Pat. No. 6,708,011 discloses a constitution in which a plurality of cartridges is accommodated in a box-like pulling-out portion (supporting member) and each of the cartridges can be exchanged in a state in which the pulling-out portion is pulled out from a main assembly casing toward a front side.

Further, U.S. Patent Application Publication No. 2007/0071494 discloses a constitution in which a pulling-out portion for accommodating a plurality of cartridges is pulled out from a main assembly casing toward a front side to be moved to a pulled-out position in which exchange of each of the cartridges is performed and then is further moved upwardly with respect to the pulling out direction, so that the pulling-out portion is disengageable from the apparatus main assembly.

By the above-described image forming apparatuses, operativity of the cartridge exchange is improved and the pulling-out portion can be disengaged from the apparatus main assembly, so that a large opening can be ensured at the front surface of the apparatus main assembly. For this reason, it is possible to easily clear jammed paper remaining inside the apparatus main assembly.

SUMMARY OF THE INVENTION

A principal object of the present invention is to improve operativity of a supporting member when the supporting member is disengaged from an apparatus main assembly.

According to an aspect of the present invention, there is provided an electrophotographic image forming apparatus comprising:

an electrophotographic image forming apparatus main assembly including a preventing portion;

a supporting member for supporting a plurality of electrophotographic photosensitive members, the supporting member being movable between an inside position inside the main assembly and an outside position outside the main assembly in a state in which the supporting member is supported by the main assembly and being disengageable from the main assembly at the outside position;

a handle portion, provided to the supporting member, to be touched for disengaging the supporting member from the main assembly; and a portion to be prevented, provided to the supporting member, being movable between a preventing position in which the portion to be prevented contacts the preventing portion in order to prevent the supporting member from being disengaged from the main assembly and a retracted position in which the portion to be prevented is retracted from the preventing position in order to disengaging the supporting member from the main assembly;

wherein the portion to be prevented is moved from the preventing position to the retracted position by the touch of the handle portion.

According to another aspect of the present invention, there is provided a supporting member, for supporting a plurality of electrophotographic photosensitive members, being movable between an inside position inside an electrophotographic image forming apparatus main assembly including a preventing portion; and an outside position outside the main assembly in a state in which the supporting member is supported by the main assembly and being disengageable from the main assembly at the outside position, the supporting member comprising:

a handle portion to be touched for disengaging the supporting member from the main assembly; and a portion to be prevented being movable between a preventing position in which the portion to be prevented contacts the preventing portion in order to prevent the supporting member from being disengaged from the main assembly and a retracted position in which the portion to be prevented is retracted from the preventing position in order to disengaging the supporting member from the main assembly, the portion to be prevented being moved from the preventing position to the retracted position by the touch of the handle portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, with reference to the drawings, embodiments of the present invention will be described more specifically in an exemplary manner. However, dimensions, materials, shapes, and relative arrangements of constituent elements described in the following embodiments may be appropriately changed depending on constitutions and various conditions for apparatuses or devices to which the present invention is to be applied. Therefore, it should be understood that the present invention is not limited to those specifically described in the following embodiments.

The present invention relates to an electrophotographic image forming apparatus, to which a process cartridge is detachably mountable, for forming an image on a recording material.

The electrophotographic image forming apparatus forms an image on the recording material through an electrophotographic image forming method. The electrophotographic image forming apparatus may include, e.g., an electrophotographic copying machine, an electrophotographic printer (such as a laser beam printer or an LED printer), a facsimile apparatus, a word processor, etc.

The process cartridge means a cartridge, prepared by integrally supporting the electrophotographic photosensitive member and process means such as a charging means, a developing means, and the like acting on the photosensitive member, detachably mountable to a main assembly of the electrophotographic image forming apparatus.

The process cartridge can be mounted to and demounted from the image forming apparatus main assembly by a user himself (herself), so that it is possible to easily perform maintenance of the image forming apparatus main assembly.

Embodiment 1

General Structure of Image Forming Apparatus

Figure 1:
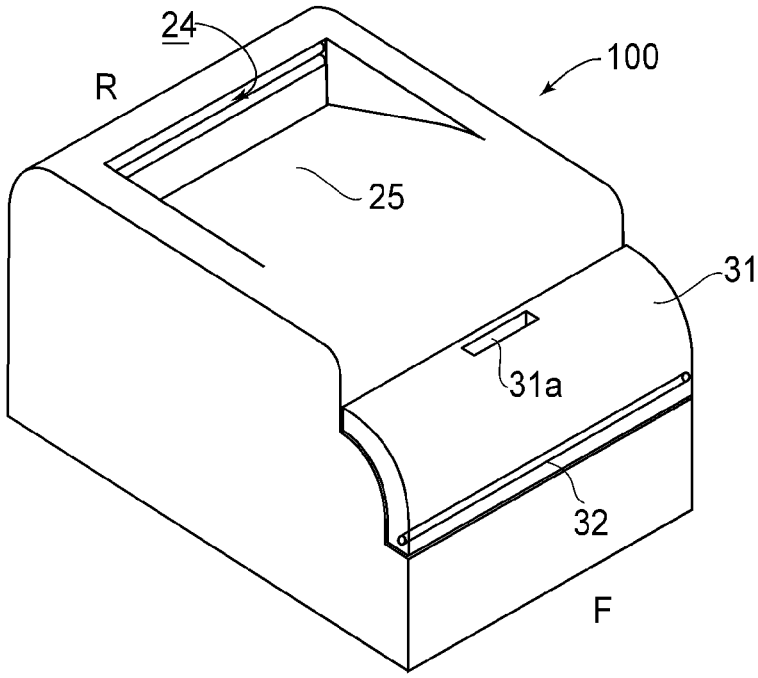
FIG. 1 is a perspective view of an outer appearance of an image forming apparatus in Embodiment 1.
Figure 2:
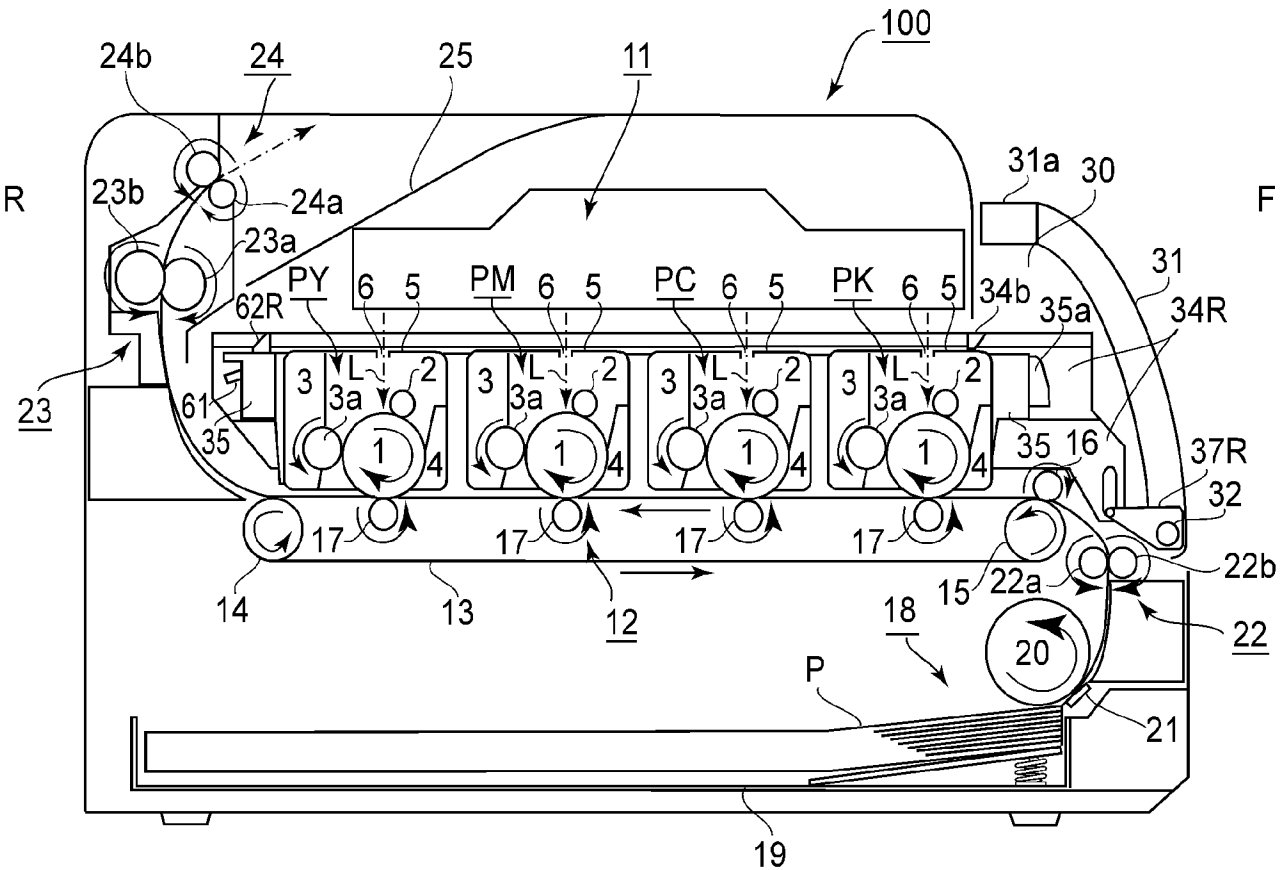
FIG. 2 is a longitudinal sectional view showing a schematic structure of the image forming apparatus in Embodiment 1.

FIG. 1 is a perspective view of an outer appearance of an image forming apparatus 100 in this embodiment, and FIG. 2 is a longitudinal left side sectional view showing a schematic structure of the image forming apparatus 100 as seen from a left side of the image forming apparatus 100. The image forming apparatus 100 is a four color-based full-color laser printer using an electrophotographic process. The image forming apparatus 100 forms an image on a recording material (such as a sheet) S on the basis of an electrical image signal input from an external host device (not shown) such as a personal computer, an image reader, or a remote facsimile machine.

In the following description, a front side (front surface side indicated by "F" in FIG. 1) of the main assembly of the image forming apparatus 100 (hereinafter, referred also to as an apparatus main assembly) means the side on which an openable door 31 which is openable with respect to the apparatus main assembly is provided. A rear side (indicated by "R" in FIG. 1) of the apparatus main assembly is the side opposite to the front side. A front-rear direction includes a frontward direction toward front as seen from the rear side of the apparatus main assembly and a rearward direction opposite to the frontward direction. The left and right sides means the left and right sides as seen from the front side of the apparatus main assembly. A left-right direction includes a leftward direction toward left as seen from the front side and a rightward direction opposite to the leftward direction. An upward direction and a downward direction is based on a vertical direction in a state in which the image forming apparatus is properly mounted.

Figure 9:
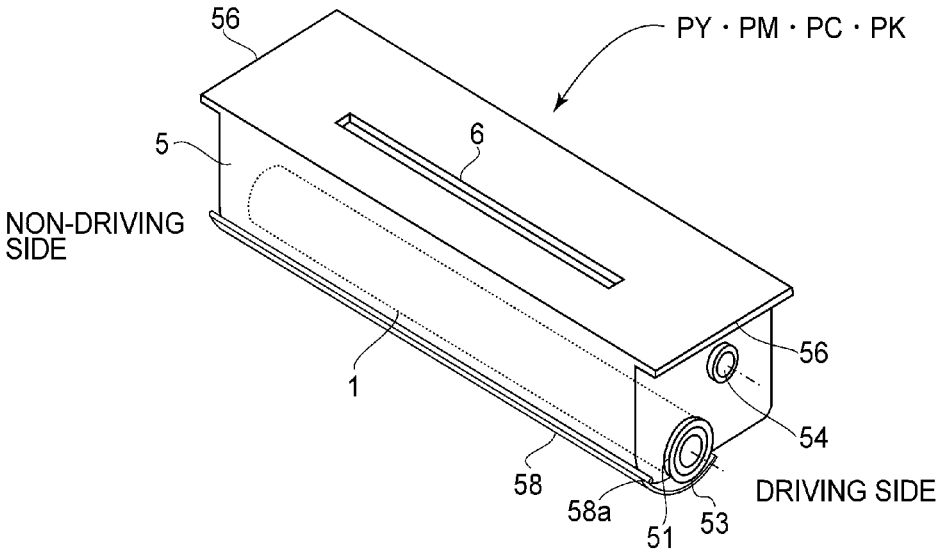
FIG. 9 is a perspective view of an outer appearance of a cartridge as seen from a driving side.
Figure 10:
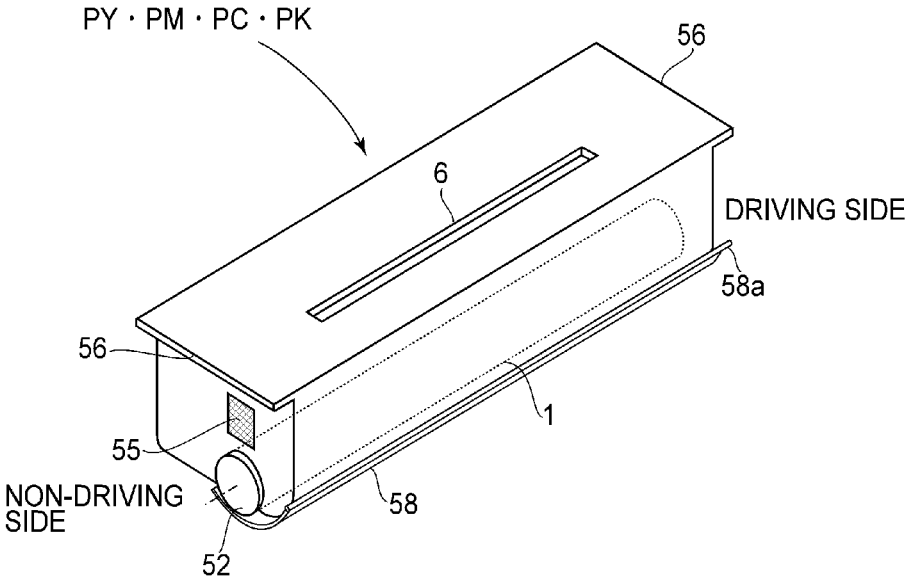
FIG. 10 is a perspective view of an outer appearance of the cartridge as seen from a non-driving side.

In the apparatus main assembly, four (first to fourth) process cartridges PY, PM, PC and PK are horizontally arranged side by side in this order in terms of the rear-to-front direction (inline or tandem arrangement). The four cartridges have the same constitution except that colors of developers (toners) accommodated therein are different from each other. Each cartridge in this embodiment includes an electrophotographic photosensitive member (also referred to as a drum) 1 as a first image bearing member and includes process means acting on the drum 1, which are integrally assembled with the drum 1 in a cartridge frame 5 (FIGS. 9 and 10). The process means acting on the drum 1 may include a charging device 2, a developing device 3, and a cleaning device 4. The charging device 2 in this embodiment is a contact charging roller. The developing device 3 includes a developing roller 3*a* and a developer container in which the developer (toner) is accommodated. The cleaning device 4 is, e.g., of a blade type.

The developing device 3 of the first cartridge PY stores yellow (Y) toner. On the surface of the drum 1 of the cartridge PY, a toner (developer) image of yellow (Y) is formed. The developing device 3 of the second cartridge PM stores magenta (M) toner. On the surface of the drum 1 of the cartridge portion PM, a toner image of magenta (M) is formed. The developing device 3 of the third cartridge PC stores cyan (C) toner. On the surface of the drum 1 of the cartridge PC, a toner image of cyan (C) is formed. The developing device 3 of the fourth cartridge PK stores black (K) toner. On the surface of the drum 1 of the cartridge PK, a toner image of black (K) is formed.

In the area above the first to fourth cartridges PY, PM, PC, and PK, a laser scanner unit 11 is disposed. This scanner unit 11 outputs a beam of laser light modulated correspondingly to image (picture) information for each color input from the external host device. The output laser light enters each cartridge through an exposure window 6 (FIGS. 2, 5 and 7) provided at an upper surface of the cartridge frame 5. Thus, laser scanning exposure is performed on the surface of the drum 1.

An electrostatic attraction conveyance belt unit 12 is disposed below the cartridges PY, PM, PC, and PK. The belt unit 12 is formed of a dielectric material and includes an endless belt 13 having flexibility, and includes a tension roller 14 and a driving roller 15 around which the belt 13 is stretched and circulatively moved. The tension roller 14 is disposed on the rear side of the apparatus main assembly. The driving roller 15 and the auxiliary roller 16 are disposed on the front side of the apparatus main assembly. An attracting roller 16 is disposed opposite to the driving roller 15 while contacting the belt 13. A lower surface of the drum 1 of each cartridge P contacts an upper surface of an upper belt portion of the belt 13. Inside the belt 13, four transfer rollers 18 are disposed so as to oppose the drum 1 of the corresponding cartridge through the upper belt portion of the belt 3.

Below the belt unit 12, a sheet feeding unit 18 is disposed, which includes a sheet feeding tray 19, a sheet a feeding roller 20, a separation pad 21, a conveyance roller pair 22, and the like. The sheet feeding tray 19 is detachably mountable in the apparatus main assembly from the front side of the apparatus main assembly (front loading).

At an upper portion on the rear side of the apparatus main assembly, a fixing device 23 and a sheet discharging roller pair 24 are disposed. Further, at an upper surface of the apparatus main assembly, a sheet discharging tray 25 is provided. The fixing device 23 includes a fixation film assembly 23*a* and a pressing roller 23*b*. The sheet discharging roller pair 24 includes sheet discharging rollers 24*a* and 24*b*.

Each cartridge placed in a state in which it is set at a set position in the apparatus main assembly 100A is urged by an urging member to be held in a state in which each cartridge is fixed to a predetermined positioning portion. To a driving input portion of each state, a driving out portion of the apparatus main assembly is connected. Further, to electrical contacts of each cartridge, an electric energy supplying system of the apparatus main assembly is electrically connected.

An operation for forming a full-color image is as follows. With predetermined control timing, the sheet feeding roller 20 is driven. As a result, by cooperation between the sheet feeding roller 20 and the separation pad 21, the recording material (sheets) P stacked on the sheet feeding tray 19 is separated and fed one by one to be introduced into a nip between the conveyance roller pair 22. To the conveyance roller pair 22, the recording material detecting sensor (not shown) is provided and detects that the recording material P reaches the conveyance roller pair 22. After the recording material detects that the recording material P reaches the conveyance roller pair 22 and a predetermined time is elapsed, the conveyance roller pair 23 is driven, so that the recording material P is introduced into a nip between the attracting roller 16 and the belt 13.

On the other hand, each drum 1 of the first to fourth cartridges PY, PM, PC and PK is rotationally driven in a clockwise direction indicated by an arrow in FIG. 2 at a predetermined control speed. The belt 13 is rotationally driven in a counterclockwise direction indicated by an arrow in FIG. 2 (in the same direction as the rotational direction of the drum 1 at the contact portion with the drum 1) at a speed corresponding to the speed of the drum 1. Further, the scanner unit 11 is also driven.

The recording material P is electrically charged by an electrostatic bias applied from the attracting roller 16 during a process in which the recording material P is nip-conveyed between the attracting roller 16 and the belt 13. As a result, the recording material P is electrostatically attracted by the belt 13, thus being conveyed to each of the nips between the belt 13 and the respective cartridges PY, PM, PC and PK by the rotation of the belt 13.

When the recording material P is detected by the recording material detecting sensor provided to the conveyance roller pair 22, the charging roller in each cartridge uniformly electrically charges the surface of the drum 1 to predetermined polarity and potential with predetermined control timing. The scanner unit 11 scans (exposes) the surface of each drum 1 with the beam of laser light modulated correspondingly to the picture (image) signal for an associated color. As a result, an electrostatic latent image corresponding to the picture signal for the associated color is formed on the surface of the drum 1. The thus formed electrostatic latent image is developed by the developing device 3 into a toner image.

Through the above described electrophotographic image forming process operation, a yellow toner image, which corresponds to the yellow (Y) color component of a full-color image is formed on the drum 1 of the first cartridge PY and is transferred onto the recording material P conveyed to the belt 13. On the drum 1 of the second cartridge PM, a magenta (M) toner image, which corresponds to the magenta component of the full-color image is formed and is transferred onto the Y toner image which has already been transferred onto the recording material P in a superposition manner. On the drum 1 of the third cartridge PC, a cyan (C) toner image, which corresponds to the cyan component of the full-color image is formed and is transferred onto the Y and M toner images which have already been transferred onto the recording material P in the superposition manner. On the drum 1 of the fourth cartridge PK, a black (K) toner image, which corresponds to the black component of the full-color image is formed and is transferred onto the Y, M and C toner images which have already been transferred onto the recording material P in the superposition manner. Thus, unfixed full-color toner images of four colors of Y, M, C and K are synthetically formed.

In each cartridge, untransferred toner remaining on the drum 1 surface after the transfer of the toner images onto the recording material P is removed by the cleaning device 4.

The recording material P is separated from the surface of the belt 13 and is then introduced into the fixing device 23, in which the recording material P is subjected to heat and pressure in a fixation nip of the fixing device 23. As a result, color mixing of the respective color toner images and fixation thereof on the recording material P are performed. Thereafter, the recording material P is moved out of the fixing device 23, and then is discharged as a full-color image formation product onto the sheet discharge tray 25 by the sheet discharge roller pair 24.

(Cartridge Exchange)

Figure 3:
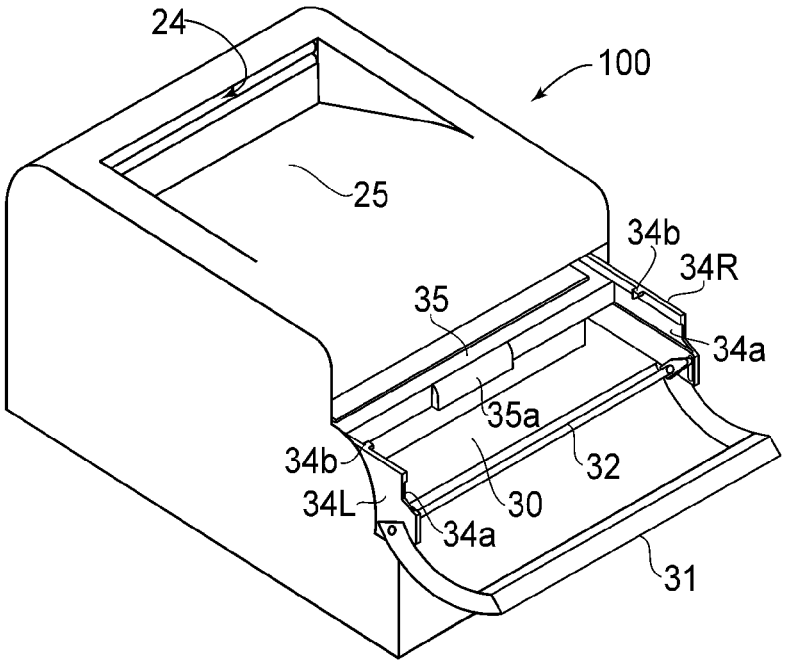
FIG. 3 is a perspective view of an outer appearance of the image forming apparatus in Embodiment 1 in a state in which a front door is opened.
Figure 4:
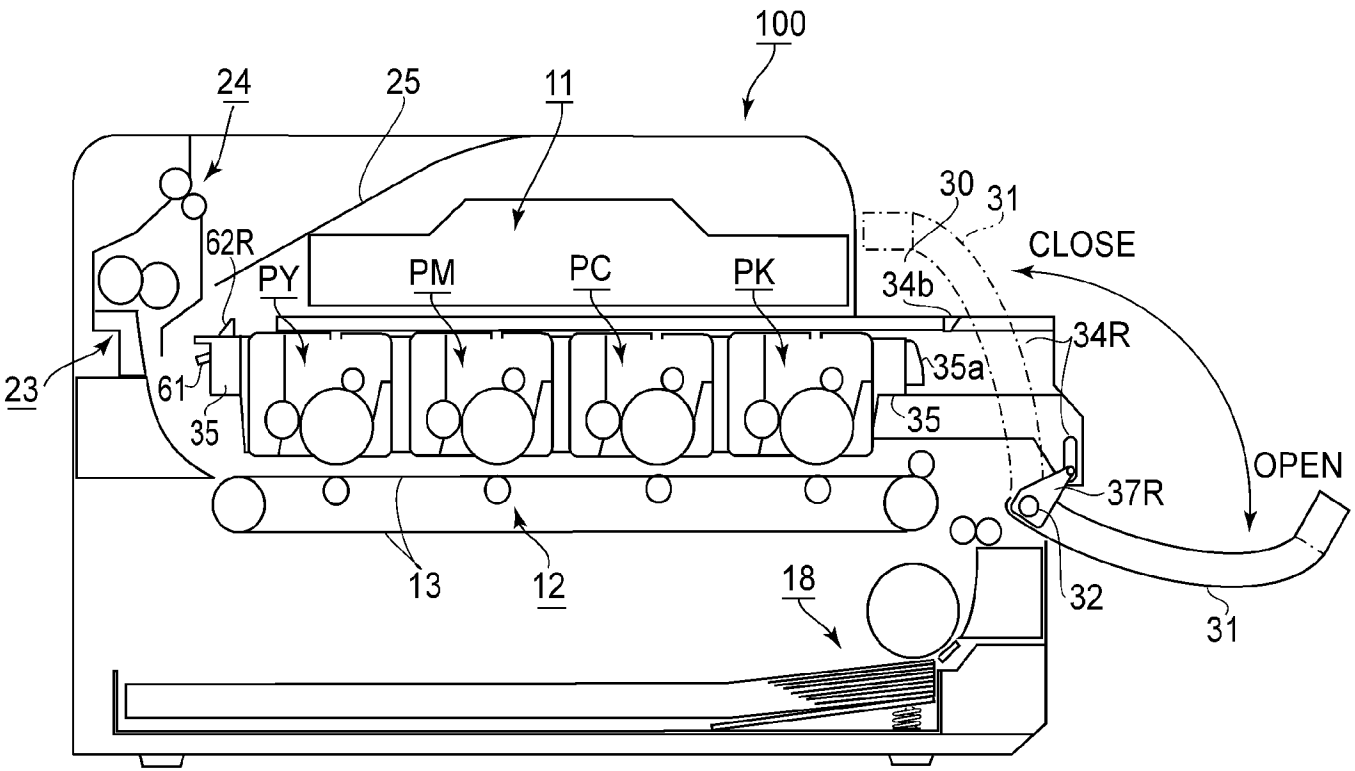
FIG. 4 is a longitudinal sectional view showing a schematic structure of the image forming apparatus in a state shown in FIG. 3.

FIG. 3 is a schematic perspective view showing an outer appearance of the image forming apparatus in a state in which the door 31 is opened. FIG. 4 is a longitudinal sectional view showing a schematic structure of the image forming apparatus in the state shown in FIG. 3 as seen from the left side of the apparatus main assembly.

As each of the first to fourth cartridges PY, PM, PC and PK is used for image formation, the developer (toner) stored in the developing device 3 is consumed. Then, when the developer is consumed to such an extent that an image of a quality satisfactory to a user who has purchased the cartridge cannot be formed, the commercial value of the cartridge is lost.

For this reason, e.g., the image forming apparatus is provided with a means (not shown) for detecting an amount of the developer remaining in each cartridge. The detected amount of the developer in each cartridge is compared, by a control portion, with a threshold value preset for providing a prewarning or warning of the lifetime of the cartridge. When the detected amount of the residual developer in the cartridge is smaller than the preset threshold value, the prewarning or warning of the lifetime of the cartridge is displayed on a display portion. As a result, the image forming apparatus prompts the user to prepare a cartridge for exchange, or to replace the cartridge with a fresh cartridge, in order to maintain an output image quality.

In this embodiment, the exchange (replacement) of the cartridge with respect to the image forming apparatus is performed through a method in which the cartridge is placed on a pulling-out tray and is replaced in a front-access manner in order to improve usability.

On the front surface side of the image forming apparatus, an opening 30 (FIG. 2) through which the cartridge passes in order to insert the cartridge into the apparatus main assembly or in order to demount the cartridge from the apparatus main assembly is provided.

Further, the door 31 an openable member movable between a closing position in which the opening 30 is covered and an opening position in which the opening 30 is exposed.

In this embodiment, the door 31 can be opened and closed and can be rotationally moved relative to the apparatus main assembly about a hinge shaft (lateral shaft) 32 provided at a lower portion of the door 31. That is, the door 31 is rotated about the hinge shaft 32 so that it can be moved in a raising direction to be placed in a closed state as shown in FIGS. 1 and 2. Thus, by placing the door 31 in the closed state, the opening 30 is covered. Further, the door 31 is rotated frontward and downward about the hinge shaft 32 to be placed in the open state with respect to the image forming apparatus as shown in FIGS. 3 and 4. As a result, the opening 30 at the front surface of the apparatus main assembly is largely exposed. To the door 31, a holding portion (finger placement portion) 31*a* (FIG. 1) for opening/closing the door 31 is provided.

Figure 17:
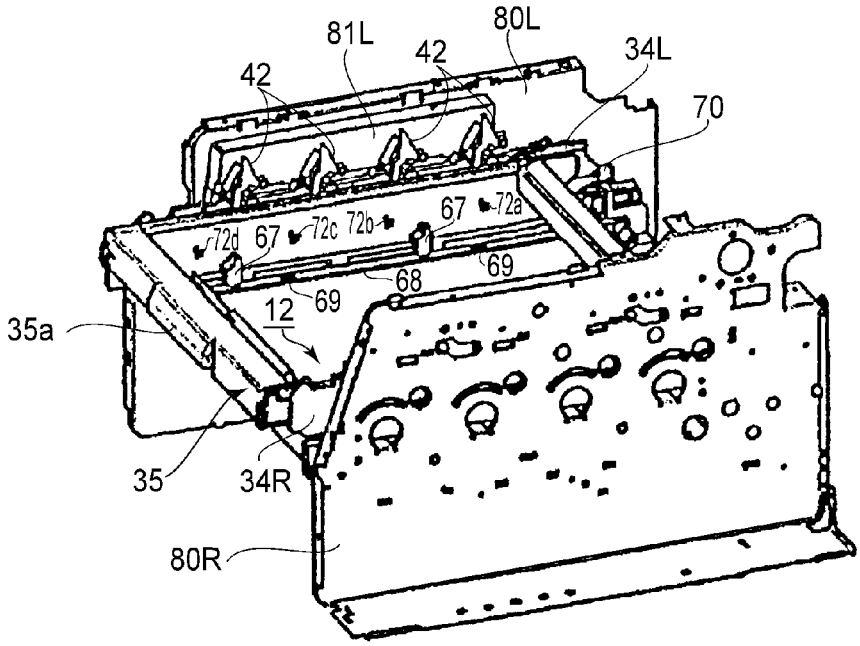
FIGS. 17 and 18 are perspective views each showing a schematic structure of a main frame constituting the apparatus main assembly.
Figure 18:
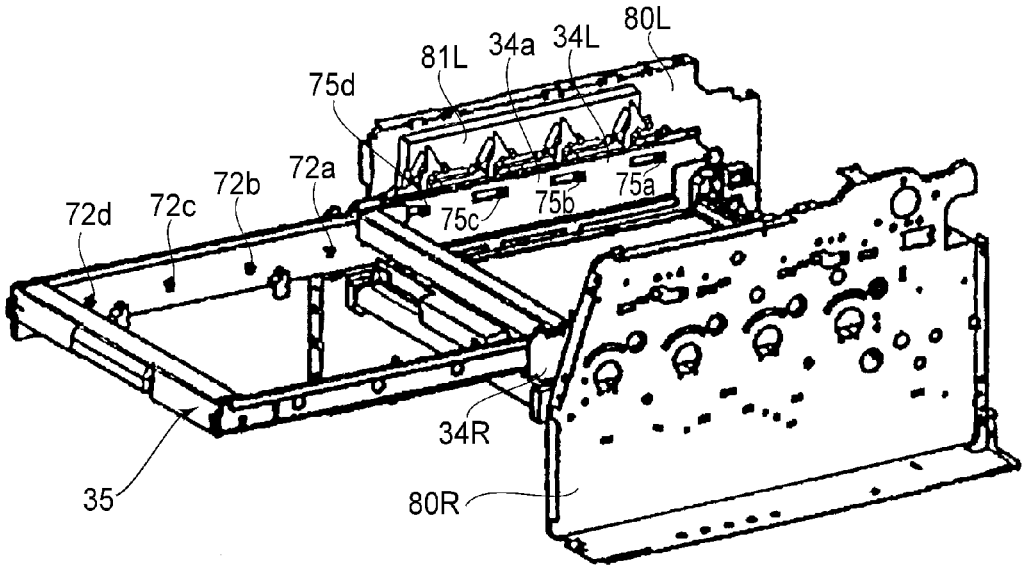

Inside left and right frames 80L (FIGS. 17 and 18) and 80R of a main frame 80 of the apparatus main assembly, a pair of left and right tray holding members 34L and 34R is disposed, respectively, so as to oppose each other. A longitudinal (lengthwise) direction of each of the tray holding members 34L and 34R coincides with the front-rear direction of the apparatus main assembly. FIGS. 17 and 18 are perspective views each showing a schematic structure of the main frame of the apparatus main assembly. Between the left and right tray holding members 34L and 34R, a cartridge tray (frame member) 35 as a supporting member is held horizontally slidably in the front-rear direction of the apparatus main assembly. The cartridges PY, PM, PC and PK are supported by the tray 35. In this case, in interrelation with the opening rotation of the door 31, the above-described tray holding members 34L and 34R are moved forward and upward by a predetermined distance. As a result, the tray holding members 34L and 34R are pulled out so that their front portions are located at a position projected from the opening to the outside of the apparatus main assembly by a predetermined distance.

In interrelation with the movement of the tray holding 34L and 34R, drive output portions on the apparatus main assembly side are disengaged from corresponding drive input portions of each of the cartridges PY, PM, PC and PK (driven portion disengagement). Further, the urging by the urging member which positions and fixes each cartridge is released (urging release). Further, electrical conduction of the electric energy supplying system on the apparatus main assembly side to the electrical contacts of each cartridge is ceased (electrical disconnection). Further, the positioning and fixing of the tray 35 is released.

Then, a handle portion 35*a* provided to a front frame portion of the tray 35 and exposed from the opening 30 is touched with fingers and is slid (pulled out) along the tray holding members 34L and 34R as if a drawer is opened, thus being slidably moved horizontally and frontward. Then, as shown in FIGS. 5 and 6, the tray 35 is sufficiently pulled out through the opening 30 to a predetermined pulled-out position (outside position) located outside the apparatus main assembly.

Figure 5:
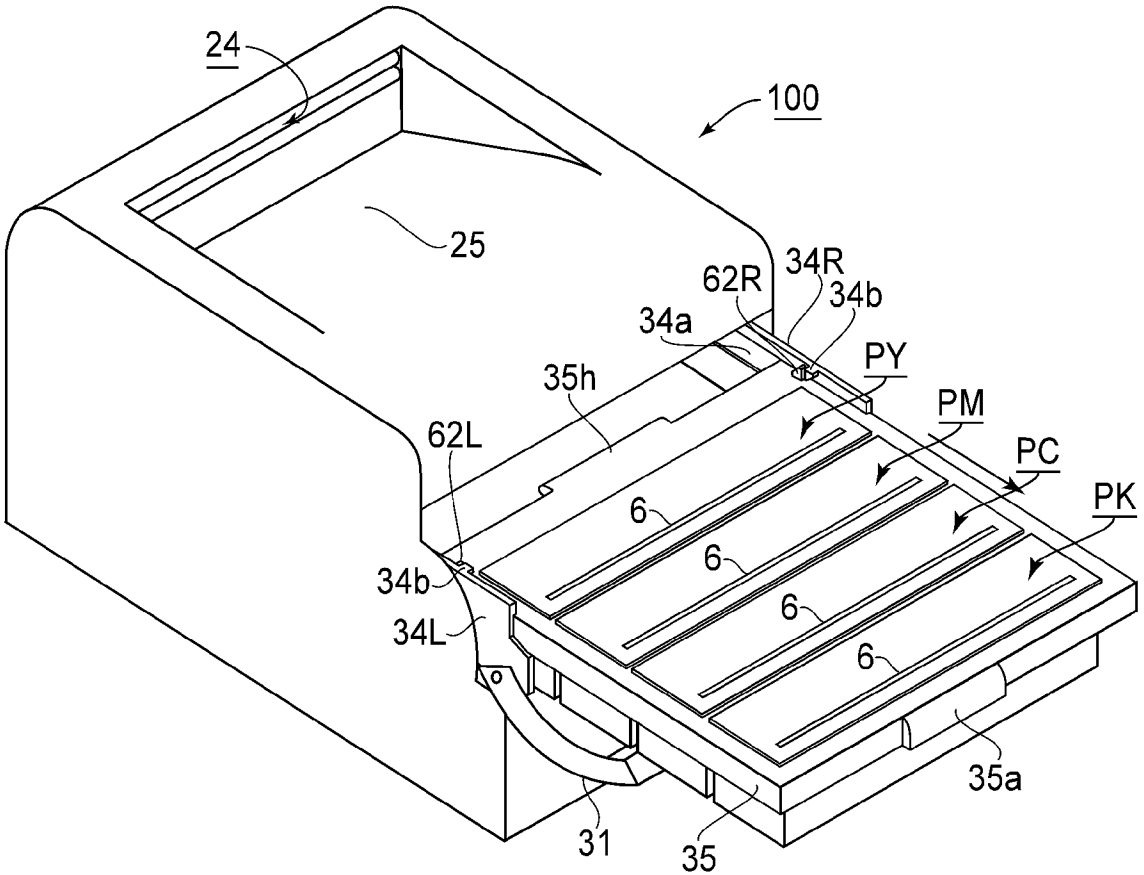
FIG. 5 is a perspective view of an outer appearance of the image forming apparatus in a state in which the tray is pulled out from the state shown in FIG. 3.

FIG. 5 is a perspective view of an outer appearance of the image forming apparatus in a state in which the tray is further pulled out from the state shown in FIG. 3.

Figure 6:
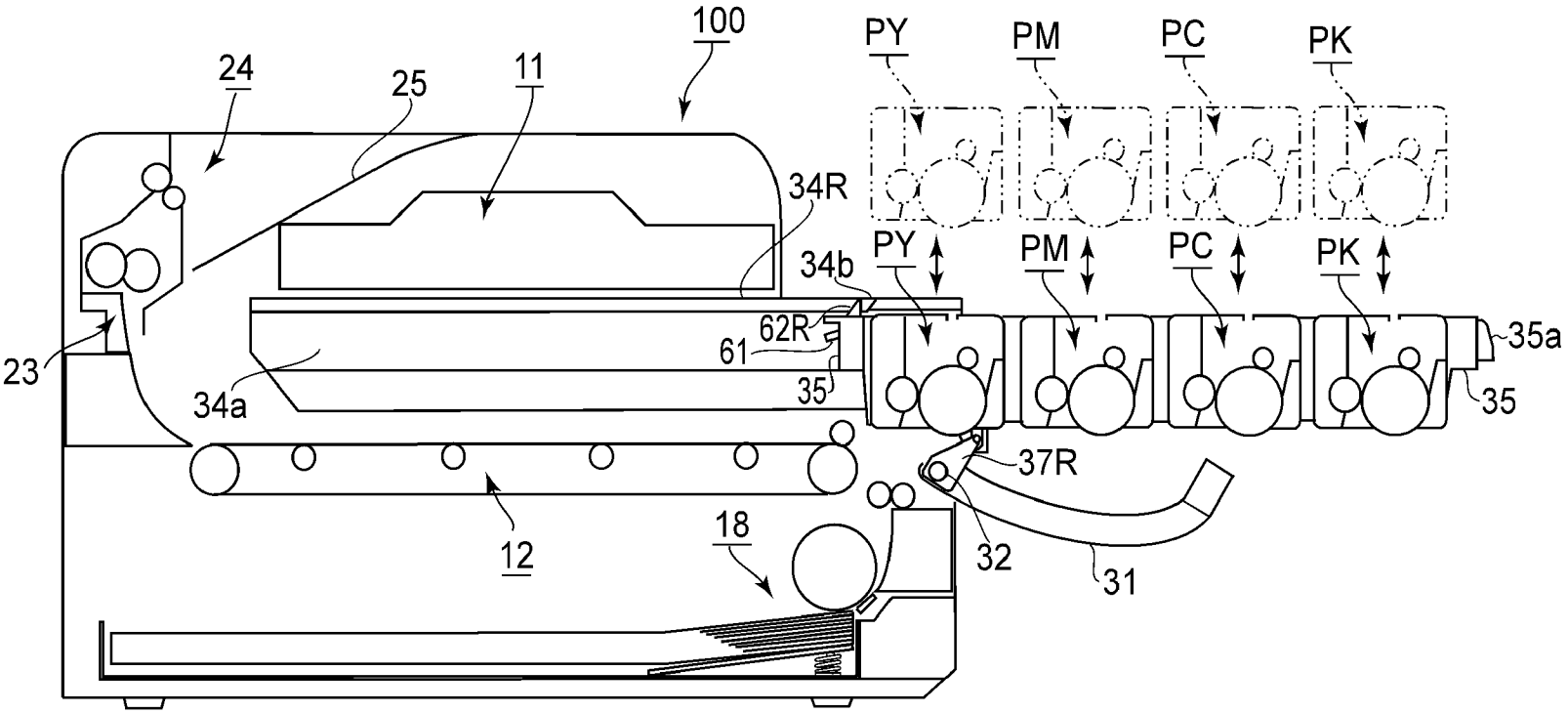
FIG. 6 is a longitudinal sectional view showing a schematic structure of the image forming apparatus in a state in which the tray is further pulled out from the state shown in FIG. 4.

FIG. 6 is a longitudinal sectional view showing the schematic structure of the image forming apparatus in a state in which the tray is further pulled out from the state shown in FIG. 4 as seen from the left side of the image forming apparatus.

As a result, the entire first to fourth (four) cartridges PY, PM, PC and PK held by the tray 35 pass through the opening 30 to be exposed to the outside of the apparatus main assembly, so that the upper surfaces of all the cartridges are exposed. The tray 35 is provided with stoppers 61L and 61R as a locking member (portion to be prevented) for preventing the tray 35 from moving in the pulling-out direction. When the tray 35 is pulled out with a predetermined distance (sufficient to expose the upper surfaces of all the cartridges), further pull-out movement of the tray 35 is prevented by contact of the stoppers 61L and 61R with locking portions 34*b* provided as a preventing portion to the tray holding members 34L and 34R. Further, the tray 35 is stable held, in the state in which it is horizontally pulled out to the predetermined pulled-out position, by the tray holding members 34L and 34R.

The tray 35 supports each cartridge so as to be detachably movable directly above. The tray 35 supports each cartridge by moving each cartridge directly below to be mounted. That is, as shown by chain double-dashed lines in FIG. 6, each cartridge can be mounted and demounted by moving each cartridge in a vertical direction. As shown by the double-dashed lines in FIG. 6, a spent cartridge P to be exchanged is raised and removed above from the tray 35. Then, a fresh cartridge is engaged in and placed on the tray 35 from above.

Below the drum 1 of each of the cartridges PY, PM, PC and PK, a drum cover 58 (FIGS. 9 and 10) for protecting the surface of the drum 1 is provided. The drum cover 58 corresponds to a cover member for protecting an exposed portion of the drum 1 exposed from the tray 35 in a state in which the drum 1 is supported by the tray 35 and is provided so that it can cover and uncover the exposed portion. The drum cover 58 is, as described later, provided so as to automatically perform its closing operation during a process in which the cartridge is raised and demounted from the tray 35. On the other hand, during a process in which the cartridge is engaged in the tray 35 from above and is placed on the tray 35, the drum cover 58 is provided so as to automatically perform its opening operation.

In the above constitution, the tray 35 is a supporting member provided movably in a drum intersecting the shaft (axial) direction of the drum 1 of the cartridge. The tray is a member capable of assuming the pulled-out position (outside position) in which the tray 35 having passed through the opening 30 is located outside and permits mounting and demounting of the cartridge, a set position in which the cartridge is mounted inside the apparatus main assembly, and a latent image forming position (inside position) in which the electrostatic latent image is formable on the drum 1.

The left and right tray holding members 34L and 34R are means for moving the tray 35 in the upward direction from the set position and in the downward direction toward the set position before the tray 35 as the supporting member is moved to the pulled-out position in which the cartridge is mountable and demountable. In other words, the tray holding members 34L and 34R are members for supporting the tray 35 and are capable of taking a first supporting position for permitting movement of the tray 35 between the pulled-out position and the set position and taking a second supporting position in which the tray 35 is located at the latent image forming position. In interrelation with the closing operation of the door 31, the tray holding members 34L and 34R are moved from the first supporting position to the second supporting position.

Further, the stoppers 62L and 62R provided to the tray 35 and the locking portions 34*b* provided to the tray holding members 34L and 34R (on the apparatus main assembly side) constitute a locking mechanism for preventing the tray 35 from being disengaged from the apparatus main assembly.

FIGS. 9 and 10 are schematic perspective views showing an outer appearance of the cartridge, in which FIG. 9 is the perspective view of the cartridge P as seen from the driving side and FIG. 10 is the perspective view of the cartridge as seen from the non-driving side.

The cartridge is an elongated box-type assembly extending in the axial direction of the drum 1 as the left-right direction (longitudinal direction). The drum 1 is rotatably supported between shaft supporting portions 51 and 52 provided at left and right side surface portions, respectively, of the cartridge frame 5. To the right shaft supporting portion 51, a coupling engaging portion 53 as the drum drive input portion is provided. To the right side surface portion of the cartridge frame 5, a coupling engaging portion 54 as the developing device drive input portion for driving the developing roller 3*a* is provided. To the left side surface portion of the cartridge frame 5, a cartridge electrical contact 55 is provided. At upper portions of the left and right side surface portions of the cartridge frame 5, eaves 56 are provided by extending and projecting the upper surface portion of the cartridge frame 5 in the left-right direction. Below the drum 1, the drum cover 58 for protecting the drum surface is urged by an urging means (not shown) so as to be placed in the closed state. With respect to the cartridge, the right side surface portion side provided with the coupling engaging portions 53 and 54 is the driving side and the left side surface portion side opposite from the right side surface portion side is the non-driving side.

Figure 11:
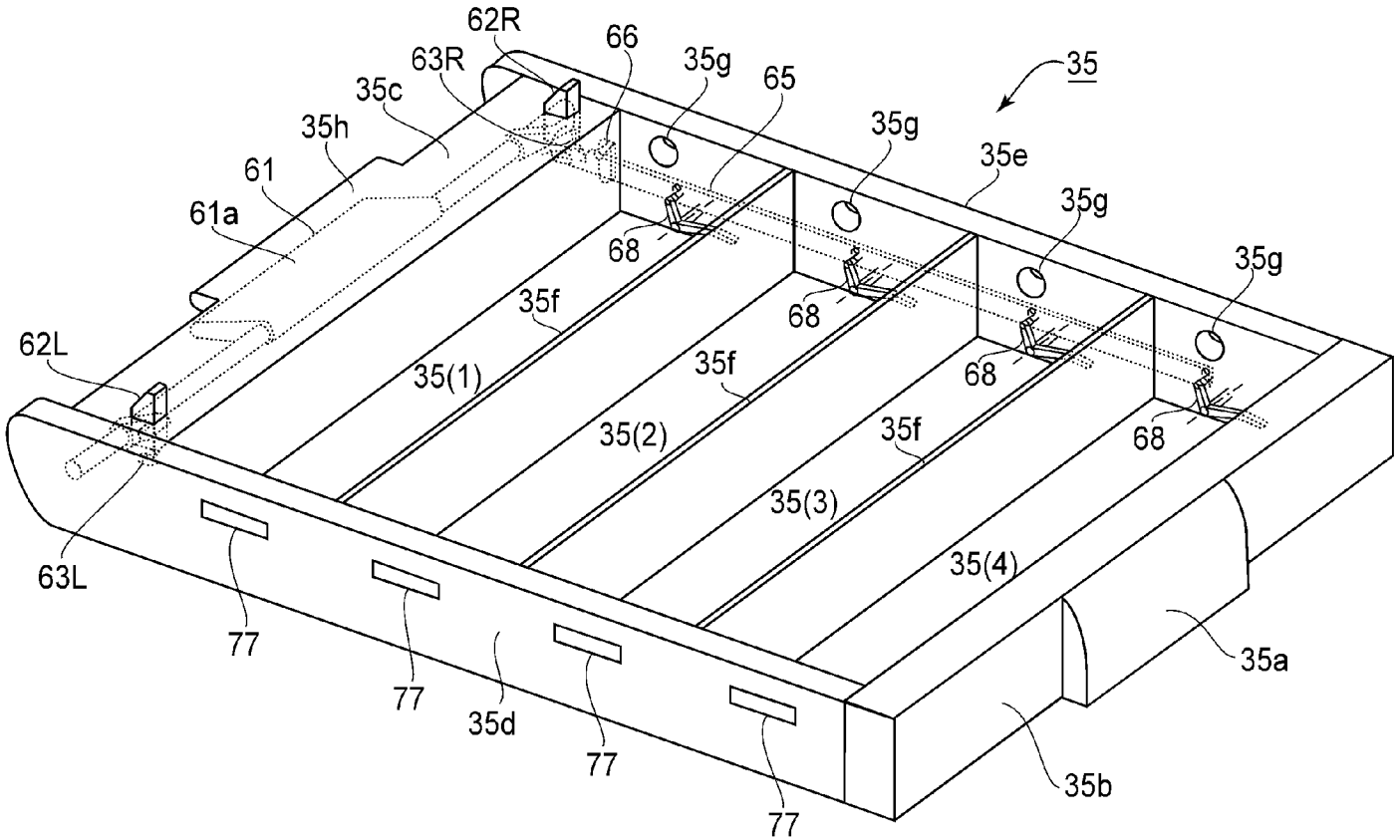
FIG. 11 is a perspective view of an outer appearance of the tray in Embodiment 1.

FIG. 11 is a schematic perspective view showing an outer appearance of the tray 35 in this embodiment.

The tray 35 includes a rectangular main frame portion prepared by connecting a front frame 35*b*, a rear frame 35*c*, a left frame 35*d*, and a right frame 35*e*. The inside of the main frame portion is substantially equally partitioned into four areas by three partitioning plates 35*f* with respect to the front-rear direction of the main frame portion, so that first to fourth elongated small frame portions 35(1) to 35(4) from the rear frame 35*c* side to the front frame 35*b* side are formed in this order in parallel to each other. The small frame portions 35(1), 35(2), 35(3) and 35(4) are portions by which the first to fourth cartridges PY, PM, PC and PK are held, respectively. With respect to each of the small frame portions 35(1) to 35(4), the right frame 35*e* is provided with a hole 35*g* though which a developing device driving coupling passes.

Further, the tray 35 includes intermediary electric contacts 72*a* to 72*d* (FIGS. 17 and 18) to be electrically connected to the electric contact 55 (FIG. 10) of each cartridge. The intermediary electric contacts 72*a* to 72*d* are electrically connectable to main assembly side electric contacts 75*a* to 75*d* (FIG. 18) provided to the apparatus main assembly.

To the rear frame 35*c* of the tray 35, a rear handle portion 35*h*, the stoppers 62L and 62R, and a releasing lever 61 as an operating member are provided. Here, the rear handle portion 35*h* and the releasing lever 61 constitute a handle portion for being handled by a user when the tray 35 is demounted from the apparatus main assembly. The stoppers 62L and 62R prevent the tray 35 from being disengaged from the apparatus main assembly. The releasing lever 61 is configured to release prevention of movement of the tray 35 toward the pulling-out direction by the stoppers 62L and 62R by being operated by the releasing lever 61. By the operation of the releasing lever 61, the stoppers 62L and 62R are retracted into the inside of the tray 35, so that the tray 35 can be demounted from the apparatus main assembly to permit processing of the recording material remaining inside the apparatus main assembly. A jam clearing method of the recording material inside the apparatus main assembly will be described.

Here, the rear handle portion 35*h* and the releasing lever 61 constitute a prevention release operating portion. The prevention release operating portion is configured to release the prevention of disengagement of the tray 35 from the apparatus main assembly with the locking mechanism so that the tray 35 is moved to a position different from the position of the handle portion 35*a* as another handle portion to be touched by the user when the tray 35 is moved from the latent image forming position (the inside position) to the pulled-out position (the outside position). Further, the rear handle portion 35*h* and the releasing lever 61 which are provided to the rear frame 35*c* of the tray 35 are located at a position in which the user cannot touch these members in a state in which the tray 35 is located at the latent image forming position (the inside position) and the user can operate these members in a state in which the tray 35 is located at the pulled-out position (the outside position). Further, the rear handle portion 35*h* and the releasing lever 61 are disposed at a downstream end portion with respect to the movement direction of the tray 35 from the latent image forming position (the inside position) to the pulled-out position (the outside position).

Further, the right frame 35*e* of the tray 35 is provided with a cover push-up member 68 for pushing up the drum cover 58 provided to each cartridge and placing the drum cover 58 in the open state. The cover push-up member 68 is provided in each of the small frame portions 35(1) to 35(4) of the tray 35 correspondingly to the respective cartridges and is rotatably supported by the right frame 35*e*. Each cover push-up member 68 is connected to the stopper 62R through a connecting rod 65 and is configured to be rotated in interrelation with the movement of the stopper 62R in the vertical direction.

Each cartridge is inserted from above into an associated small frame portion of the tray 35. Then, lower surfaces of the left and right eaves 56 are stopped by the upper surfaces of the left and right frames 35*d* and 35*e*, so that each cartridge is accommodated in and supported by the tray 35. That is, the tray 35 supports (holes) each cartridge demountably right above and supports each cartridge by moving each cartridge right below when each cartridge is mounted. The tray 35 roughly supports each of the cartridges. As a result, it is possible to easily perform exchange of each process cartridge.

The left and right frames 35*d* and 35*e* of the tray 35 are engaged with guide groove portions (FIGS. 3, 5, 6, 7 and 8)

provided on inner surfaces of the tray holding members 34L and 34R in the front-rear direction. As a result, the tray 35 is supported between the left and right tray holding members 34L and 34R and is horizontally slidably movable in the front-rear direction while sliding along the guide groove portions 34*a*.

As shown in FIGS. 5 and 6, the tray 35 is pulled out to the pulled-out position and a cartridge to be exchanged of the cartridges held in the tray 35 is exchanged and then the tray 35 is sufficiently pushed into the inside of the apparatus main assembly to be returned to the state before the pulling out as shown in FIGS. 3 and 4. Then, the opened door 31 is closed as shown in FIGS. 1 and 2.

In interrelation with the closing operation of the door 31, the tray holding members 34L and 34R are moved rearward and downward by a predetermined distance, so that each cartridge is located at the set position. In interrelation with the movement of the tray holding members 34L and 34R, each cartridge is urged by the urging member and is held in the fixed state in which it is fixed at a predetermined positioning portion, so that the lower surface of the drum 1 of each cartridge contacts the belt 13 at a predetermined position. To the drive input portion of the cartridge, the drive output position of the apparatus main assembly is connected. To the electrical contact of the cartridge, the electric energy supplying system of the apparatus main assembly is electrically connected.

(Jammed Paper Clearing Method in Apparatus Main Assembly)

Figure 7:
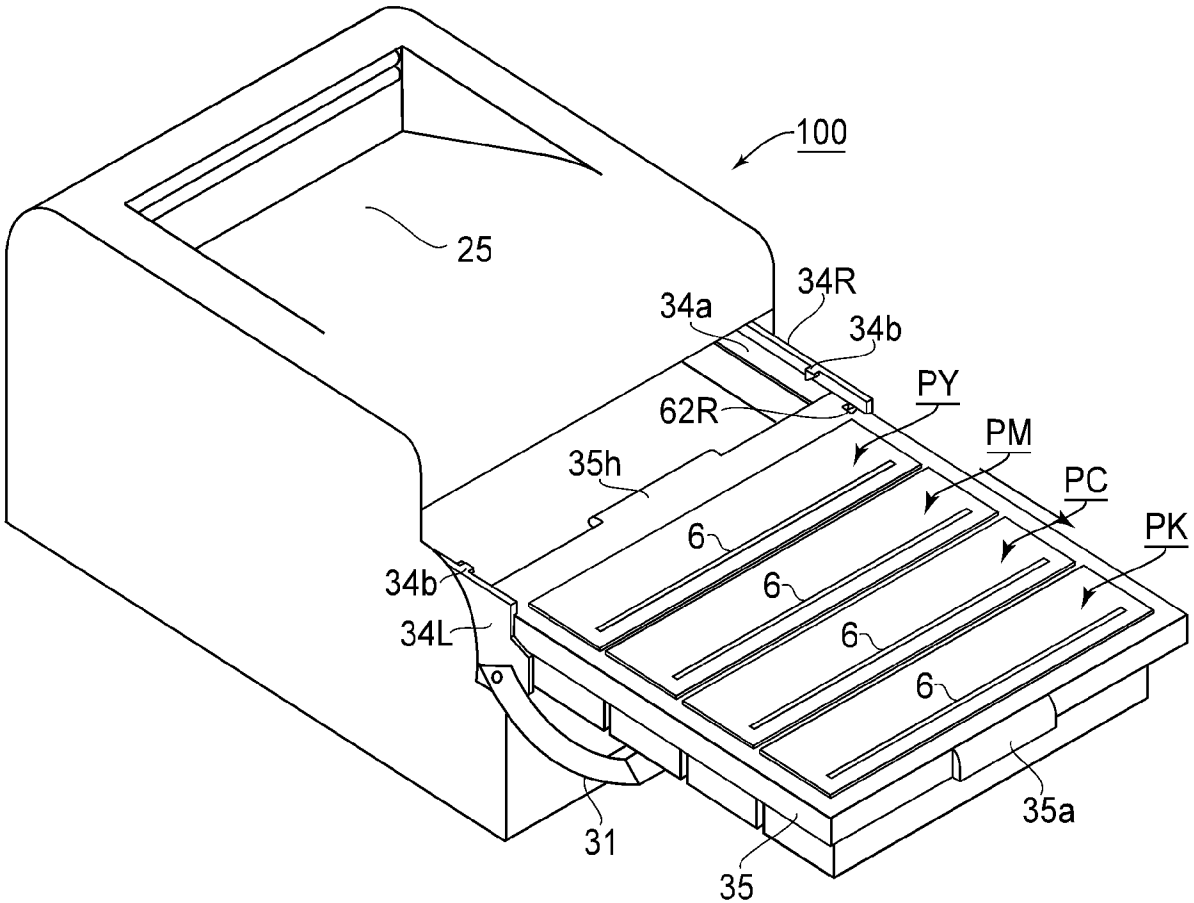
FIG. 7 is a perspective view of an outer appearance of the image forming apparatus in a state in which the tray is further pulled out from the state shown in FIG. 5.
Figure 8:
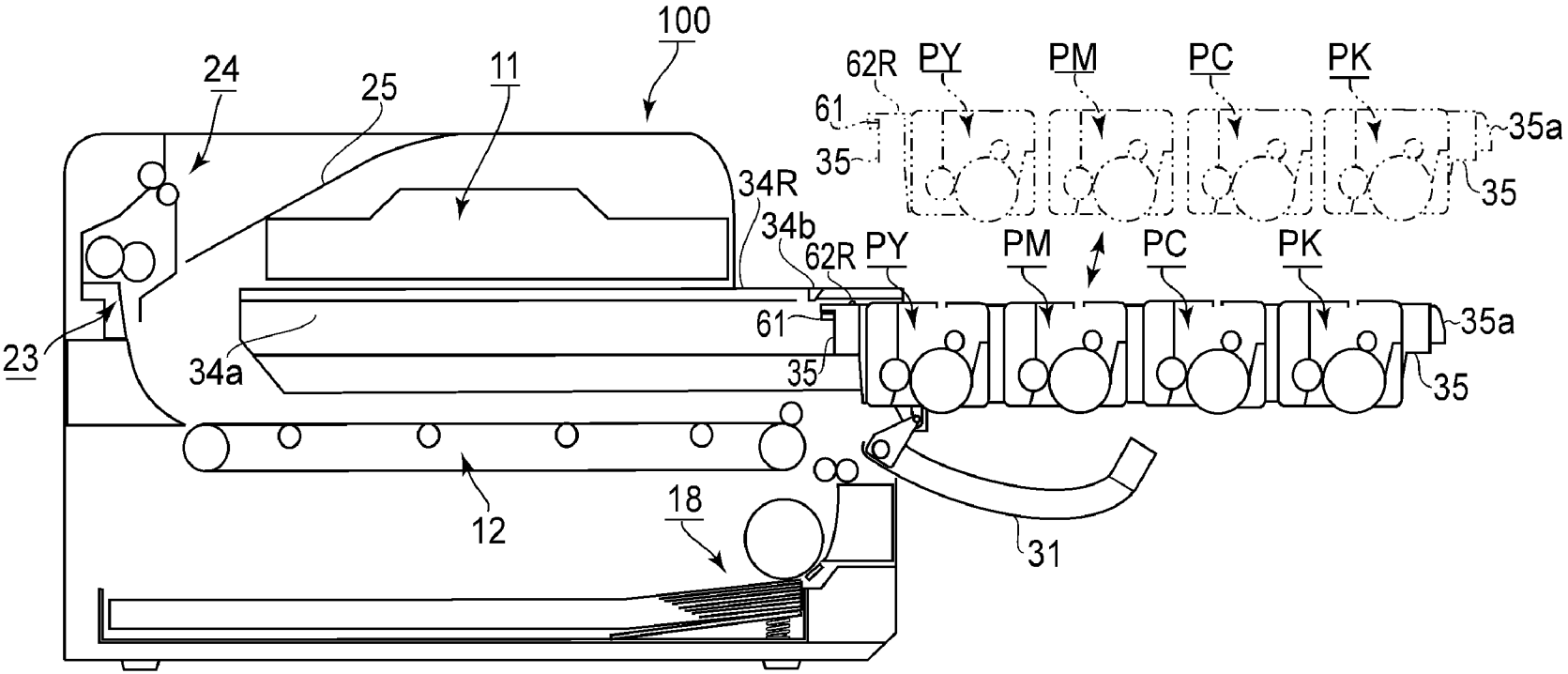
FIG. 8 is a longitudinal sectional view showing the schematic structure of the image forming apparatus in a state in which the tray is further pulled out from the state shown in FIG. 6.

FIG. 7 is a schematic perspective view showing an outer appearance of the image forming apparatus in a state in which the tray 35 is further pulled out from the state shown in FIG. 5. FIG. 8 is a longitudinal sectional view showing a schematic structure of the image forming apparatus in a state in which the tray 35 is further pulled out from the state shown in FIG. 6 as seen from the left side of the image forming apparatus.

In the case where an image is intended to e formed (printed) on the recording material with warp or crease, an end portion of the recording material is caught by the guide or the roller to cause jam in the recording material conveyance path, so that the recording material is not properly discharged outside the apparatus main assembly in some cases. Further, when the power of the apparatus main assembly is turned off during the image forming (printing) operation, the recording material is left inside the apparatus main assembly in some cases. In this way, in the state in which the recording material remains in the apparatus main assembly, a subsequent printing (image forming) operation cannot be started normally.

For this reason, e.g., by using a recording material detecting sensor (not shown) provided to the conveyance roller pair 22 or the discharging roller pair 24, whether or not the jam occurs during the printing operation or whether or not the recording material remaining inside the apparatus main assembly is present before the printing operation start is detected. In the case where the jam occurs or the remaining recording material is present inside the apparatus main assembly, display notifying the presence of the recording material in the apparatus main assembly is effected at the display portion. As a result, the user is urged to process (clear) the recording material remaining inside the apparatus main assembly.

In the image forming apparatus in this embodiment, the cartridge exchange is performed by the front-access manner using the pulling out tray. For this reason, in order to process (clear) the recording material remaining inside the apparatus main assembly, there is the need to demount the pulling out tray from the apparatus main assembly to permit the user to put his (her) hand(s) inside the apparatus main assembly through the opening on the front surface side of the apparatus main assembly.

However, in the case where the user intends to pull out the pulling out tray in order to exchange the cartridge, when the pulling out tray is unintentionally disengaged from the apparatus main assembly, there is a possibility of fall of the pulling out tray.

For this reason, in this embodiment, as described above, the stoppers 62L and 62R are provided to the tray 35 and are caused to contact the locking portions 34*b* of the tray holding members 34L and 34R, so that the tray 35 is prevented from falling from the apparatus main assembly during the cartridge exchange.

When the tray 35 is disengaged from the apparatus main assembly, the user grips the releasing lever 61 provided to the rear frame 35*c* of the tray 35 to retract the stoppers 62L and 62R to the inside of the tray 35 in a state in which the tray 35 is pulled out for the cartridge exchange (FIGS. 5 and 6).

As a result, as shown in FIGS. 7 and 8, the tray 35 is further pulled out in the pulling out direction, so that the tray 35 can be disengaged from the apparatus main assembly. At this time, the cover push-up member 68 is rotated in interrelation with the movement of the stopper 62R, so that the drum cover 58 of each cartridge is automatically in the closed state. The interrelation between the stopper 62R and the cover push-up member will be described later.

Figure 12:
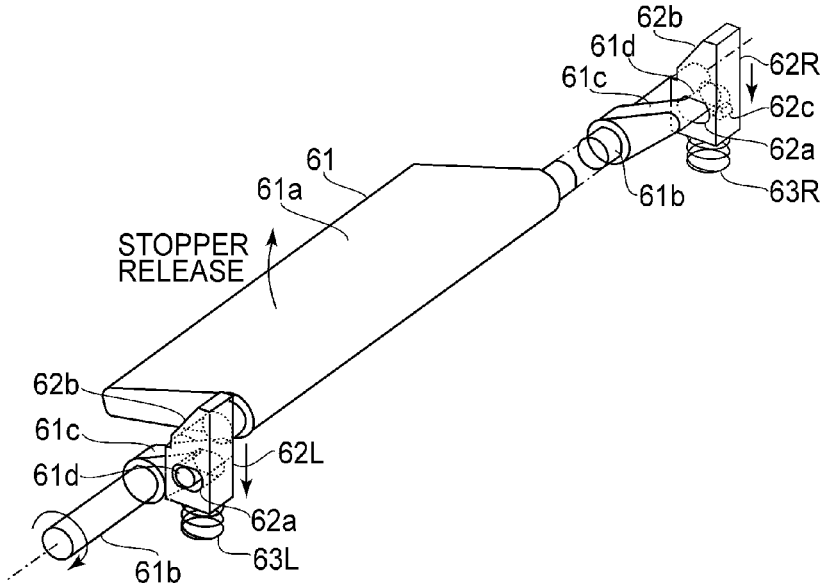
FIG. 12 is a perspective view showing a connecting mechanism portion between a releasing lever and a stopper in Embodiment 1.

FIG. 12 is a schematic perspective view showing the interrelating mechanism portion of the releasing lever 61 with the stoppers 62L and 62R.

A rotation shaft portion 61*b* of the releasing lever 61 is horizontally disposed in the left-right direction with respect to the apparatus main assembly and both left and right end portions are rotatably shaft-supported between the left and right frames 35*d* and 35*e* of the tray 35. To a central portion of the rotation shaft portion 61*b*, the operating portion 61*a* to be touched by the user is provided. The operating portion 61*a* is exposed from a lower portion of the rear handle portion 35*h* provided to the rear frame 35*c* of the tray 35 toward the outside of the tray 35. Further, at portions close to the left and right ends of the rotation shaft portion 61*b*, arm portions 61*c* are provided with the same phase. At an end portion of each of the left and right arm portions 61*c*, a horizontal shaft 61*d* is formed to project toward the outside of the tray 35.

The stoppers 62L and 62R are held at a position in which they are projected from portions of the main body of the tray 35 so as to be slidable in the vertical direction (the direction perpendicular to the movement direction of the tray 35) with respect to the rear frame 35*c* of the tray 35 (hereinafter, this position is referred to also as a first position). The left horizontal shaft 61*d* is engaged in an elongated hole 62*a* provided to the stopper 61L and the right horizontal shaft 61*d* is engaged in an elongated hole 62*a* provided to the stopper 62R. Here, the rotation shaft portion 61*b*, the arm portions 61*c*, the horizontal shafts 61*d*, and the elongated holes 62*a* constitute a moving means for moving the stoppers 61L and 61R from the first position by operating the releasing lever 61.

As a result, when the releasing lever 61 is rotated in the direction indicated by an arrow shown in FIG. 12, the left and right stoppers 62L and 62R are moved downward along the grooves provided to the rear frame 35 of the tray 35, so that the stoppers 62L and 62R are retracted to a position in which they doe not contact the locking portions 34*b* of the tray holding members 34L and 34R (hereinafter referred to as a second position). That is, the user handles the operating portion (handle portion) 61*a* of the releasing lever 61, so that the releasing lever 61 is rotated in the direction indicated by the arrow shown in FIG. 12. As a result, the left and right stoppers 62L and 62R are retracted to the position in which they do not contact the locking portions 34*b* of the tray holding members 34L and 34R.

Further, the stoppers 62L and 62R are urged by springs 63L and 63R from a lower side toward an upper side (toward the first position). For this reason, when the user moves his (her) hand off the operating portion 61*a* of the releasing lever 61, the stoppers 62L and 62R are moved upwardly, so that the releasing lever 61 is rotated in a direction opposite from the direction indicated by the arrow shown in FIG. 12. Then, the releasing lever 61 and the stoppers 62L and 62R are returned to the original position (the first position), so that the stoppers 62L and 62R are in a state in which they contact the locking portions 34*b* of the tray holding members 34L and 34R.

Figure 13:
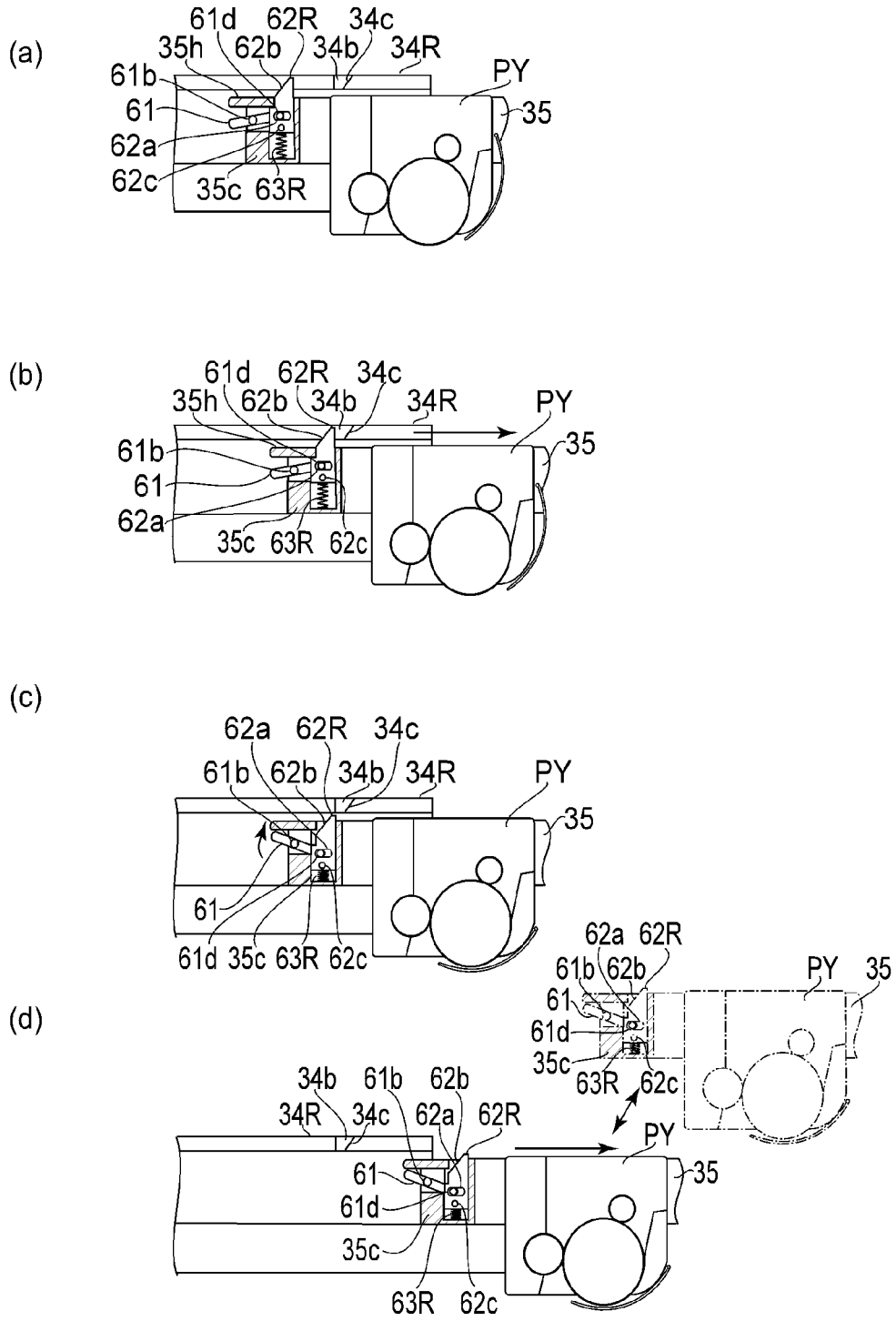
FIGS. 13(*a*) to 13(*d*) are schematic views for illustrating an operation when the tray is demounted from the apparatus main assembly and a recording material remaining inside the apparatus main assembly is processed in Embodiment 1.

FIGS. 13(*a*) to 13(*d*) are schematic views for illustrating an operation in which the tray 35 is demounted from the apparatus main assembly and the recording material remaining in the apparatus main assembly is cleared. FIG. 13(*a*) is a schematic view showing a cross section of the apparatus main assembly in the neighborhood of the rear frame 35*c* of the tray 35 in a state in which the tray 35 is moved in the direction of the front surface of the apparatus main assembly and is in a state in which the tray 35 is partly pulled out toward the pulled out position shown in FIGS. 5 and 6. FIG. 13(*b*) is a schematic sectional view showing a state in which the tray 35 is further pulled out from the position (state) shown in FIG. 13(*a*) in the direction of the front surface of the apparatus main assembly. FIG. 13(*c*) is a schematic sectional view showing the case where the releasing lever 61 provided to the rear frame 35*c* of the tray 35 is rotated in a clockwise direction about the rotation shaft portion 61*b* in the state of FIG. 13(*b*). FIG. 13(*d*) is a schematic sectional view showing a state in which the tray 35 is further pulled out from the position (state) shown in FIG. 13(*c*).

From the state of FIG. 13(*a*), the tray 35 is further pulled out in the direction of the front surface of the apparatus main assembly, as shown in FIG. 13(*b*), the stoppers 62L and 62R provided to the rear frame 35*c* of the tray 35 runs against the locking portions 34*b* provided to the tray holding members 34L and 34R. As a result, the tray 35 is prevented from moving in the direction of the front surface of the apparatus main assembly. In this state, the user can exchange of the cartridge. Here, the locking portions 34*b* can also be regarded as being provided so as to overlap with the stoppers 62L and 62R located at the first position in the case where the locking portions 34*b* are viewed from the movement direction of the tray 35 from the latent image forming position (the inside position) to the pulled out position (the outside position). The locking portions 34*b* engage with the stoppers 62L and 62R located at the first position in the case where the tray 35 is located at the pulled-out position.

When the user clears the recording material remaining in the apparatus main assembly, in the state of FIG. 13(*b*), the user handles the operating portion 61*a* of the releasing lever 61 provided to the rear frame 35*c* of the tray 35 to rotate the releasing lever 61 about the rotation shaft portion 61*b* in the clockwise direction as shown in FIG. 13(*c*). The horizontal shafts 61*d* provided to the releasing lever 61 are engaged in the elongated holes 62*a* provided to the stoppers 62L and 62R, so that the stoppers 62L and 62R are pushed downwardly against the urging force of the springs 63L and 63R by the rotation of the releasing lever 61. Thus, the stoppers 62L and 62R are lowered to a position in which they do not interfere with the locking portions 34*b* provided to the tray holding members 34L and 34R.

As a result, the prevention of the movement of the tray 35 in the direction of the front surface of the apparatus main assembly is eliminated, so that the tray 35 is pulled out further as shown in FIG. 13(*d*), so that the tray 35 can be disengaged from the tray 35 as indicated by a chain line shown in FIG. 13(*d*) (FIGS. 7 and 8).

After the tray 35 is disengaged from the apparatus main assembly, the user puts his (her) hand(s) in the apparatus main assembly through the opening 30 on the front surface side of the apparatus main assembly and can remove the recording material remaining on the belt unit 12 or in front of the fixing device 23.

As described above, in order to disengage the tray 35 from the apparatus main assembly, the user is required to perform the operation in which the user handles the handle portion 35*a* provided to the front frame 35*b* to pull out the tray 35 in the direction of the apparatus main assembly front surface while holding the operating portion 61*a* of the releasing lever 61 provided to the rear frame 35*c* of the tray 35.

For this reason, unintentional disengagement of the tray 35 from the apparatus main assembly is not caused to occur. Further, the user disengages the tray 35 from the apparatus main assembly while supporting the tray 35 with both hands with reliability. Therefore, the user does not drop the tray 35, so that it is possible to prevent an occurrence of inconvenience to the tray 35 or the cartridge due to the drop of the tray 35. Further, in interrelation with the movement of the stopper 62R, the drum cover 58 of each cartridge is automatically placed in the closed state, so that it is possible to prevent the user from touching the surface of the drum 1 with his (her) hand(s) or belongings. Therefore, it is possible to prevent deterioration in image quality due to damage of the surface of the drum 1 by the touch with the user's hand(s) or belongings.

Figure 14:
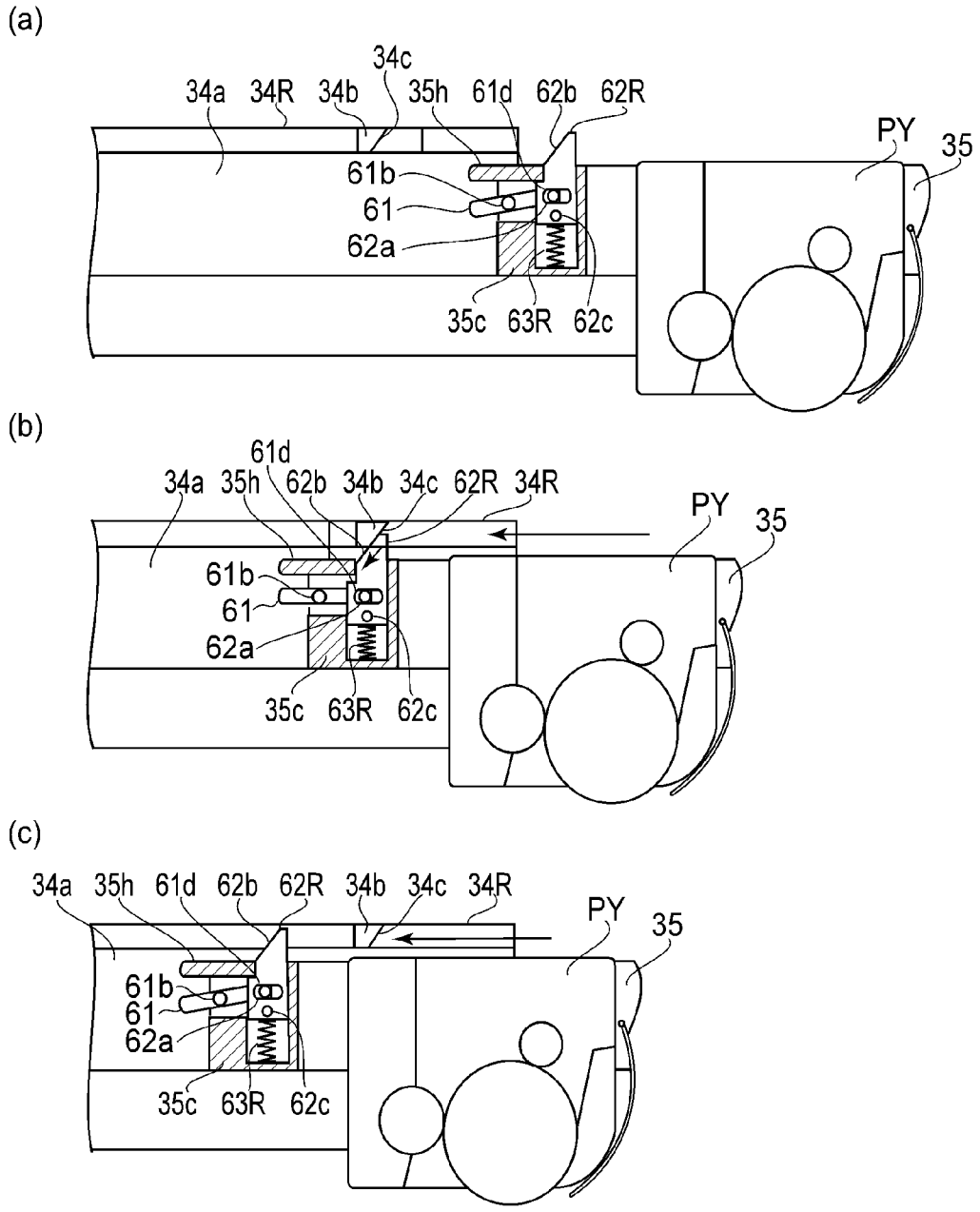
FIGS. 14(*a*) to 14(*c*) are schematic views for illustrating an operation for returning the tray having been demounted from the apparatus main assembly into the apparatus main assembly in Embodiment 1.

FIGS. 14(*a*) to 14(*c*) are schematic views for illustrating an operation for returning the tray disengaged from the apparatus main assembly into the apparatus main assembly again. FIG. 14(*a*) is a schematic sectional view showing a state in which the stoppers 62L and 62R are located outside the locking portions 34*b* with respect to the apparatus main assembly front direction. FIG. 14(*b*) is a schematic sectional view showing a state in which the tray 35 in the state of FIG. 14(*a*) is pushed in toward the apparatus main assembly rear direction to bring the stoppers 62L and 62R into contact with the locking portions 34*b*. FIG. 14(*c*) is a schematic sectional view showing a state in which the tray in the state of FIG. 14(*b*) is further pushed in toward the apparatus main assembly rear direction.

After the recording material remaining inside the apparatus main assembly is removed by the above-described method, as shown in FIG. 14(*a*), the left and right frames 35*d* and 35*e* of the tray 35 are engaged in the guide groove portions 34*a* provided inside the left and right tray holding members 34L and 34R and extending in the front-rear direction. The stoppers 62L and 62R provided to the rear frame 35*c* of the tray 35 are urged upward by the springs 63L and 63R. For this reason, when the user moves his (her) hand(s) off the operating portion 61*a* of the releasing lever 61, the stoppers 62L and 62R are automatically returned from the state in which they have a height at which they do not interfere with the locking portions 34*b* to the initial height state. That is, when the user moves his (her) hand(s) off the operating portion 61*a*, the stoppers 62L and 62R are automatically returned to the initial height state in which they interfere with the locking portions 34*b*. In interrelation with this operation, the releasing lever 61 is rotated about the rotation shaft portion 61*b* in the counterclockwise direction in the state of FIG. 14(*a*), thus being returned to the original position.

When the tray 35 in the state of FIG. 14(*a*) is pushed in toward the apparatus main assembly rear direction along the guide grooves portions 34*a* provided inside the tray holding members 34L and 34R and extending in the front-rear direction, the tray 35 is subjected to the following actions. First, as shown in FIG. 14(*b*), inclined surfaces 62*b* as a contact portion of the stoppers 62L and 62R contact inclined surfaces 34*c* as a portion to be contacted of the locking portions 34*b* provided to the tray holding members 34L and 34R. Then, when the tray 35 is further pushed in toward the apparatus main assembly rear direction, a pushing down force of the locking portions 34*b* acts on the stoppers 62L and 62R, so that the stoppers 62L and 62R are retracted inside the tray 35. Therefore, even when the stoppers 62L and 62R contact the locking portions 34*b*, the tray 35 is not prevented from moving toward the apparatus main assembly rear direction. Here, the inclined surfaces 62*b* of the stoppers 62L and 62R and the inclined surfaces 34*c* of the locking portions 34*b* correspond to guide surfaces for moving the stoppers 62L and 62R from the first position to the second position in interrelation with the moving operation of the tray 35 moving toward the apparatus main assembly rear direction. The apparatus main assembly rear direction is a direction from a downstream side, of the movement direction in which the tray 35 is moved from the latent image forming position (the inside position) to the pulled-out position (the outside position), toward the latent image forming position. In this embodiment, the guide surface is provided to both of the stoppers 62L and 62R and the locking portions 34*b* but the present invention is not limited thereto. That is, the guide surface may only be required to be provided to either one side of the stoppers 62L and 62R and the locking portions 34*b*.

Accordingly, when the disengaged tray 35 is returned into the apparatus main assembly, the tray 35 can be returned to the state shown in FIG. 14(*c*) only by sliding the tray 35 in the apparatus main assembly rear direction along the guide groove portions 34*a* provided inside the tray holding members 34L and 34R and extending in the front-rear direction. Further, the stoppers 62L and 62R are always located at the position in which the pulling out of the tray 35 is prevented in a state in which the releasing lever 61 is not operated, by being urged by the springs 63L and 63R. Therefore, there is no need to prevent the disengagement of the tray 35 after the mounting and demounting of the tray 35 with respect to the apparatus main assembly, so that unintentional disengagement of the tray 35 from the apparatus main assembly due to forgetfulness of the prevention of the disengagement of the tray 35 from the apparatus main assembly can be prevented when the cartridge is exchanged.

Figure 15:
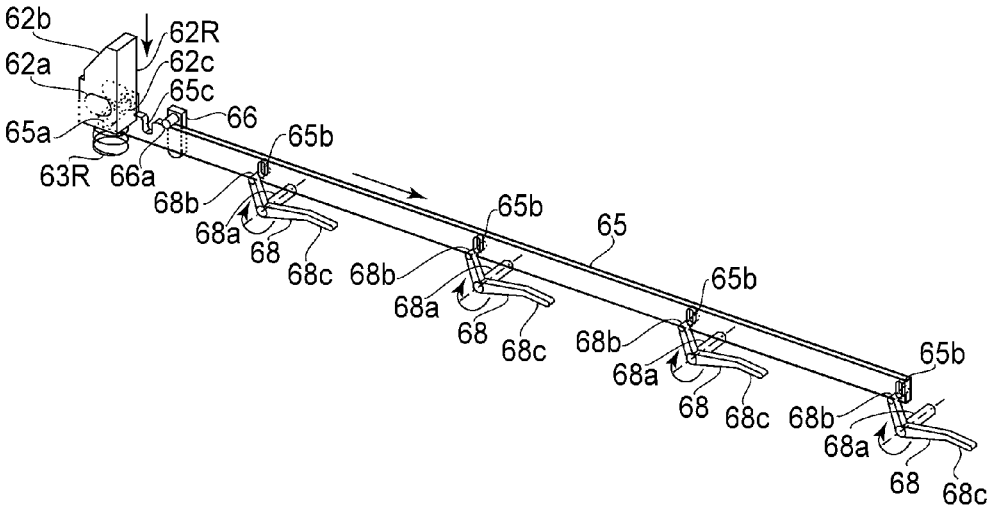
FIG. 15 is a perspective view showing a schematic structure of a connecting mechanism portion between the stopper and a cover push-up member in Embodiment 1.

FIG. 15 is a perspective view showing a schematic structure of the connecting mechanism portion between the stopper 62R and the cover push-up member 68.

Below the elongated hole 62*a* of the stopper 62R, the horizontal shaft 62*c* is formed to project toward the outside of the tray 35. On the other hand, inside the right frame 35*e* of the tray 35, the connecting rod 65 is provided slidably in the front-rear direction of the apparatus main assembly. At a rear end portion of the connecting rod, a cam groove 65*a* is formed. Further, the horizontal shaft 62*c* of the stopper 62R is engaged in the cam groove 65*a* of the connecting rod 65 (FIGS. 16A to 16D).

Inside the small frame portions of the tray 35 in which the associated ones of the cartridges are to be supported, the right frame 35*e* is provided with the cover push-up member 68 for pushing up the drum cover 58 of each cartridge. The cover push-up member 68 is supported by the right frame 35*e* so as to be rotatable about the rotation shaft 68*a*. The cover push-up member 68 includes two arms one of which is provided with a horizontal shaft 68*b* at its end.

The connecting rod 65 is provided with a vertical hole 65*b* at a position corresponding to the associated horizontal shaft 68*b* of the cover push-up member 68, and the horizontal shaft 68*b* of the cover push-up member 68 for the associated one of the cartridges is engaged in the vertical hole 65*b* of the connecting rod 65. The other arm 68*c* of the cover push-up member 68 pushes up a projection 58*a* provided to the drum cover 58 of each cartridge, so that the drum cover 58 is shifted from the closed state to the open state.

Further, in the neighborhood of the rear end portion of the right frame 35*e* of the tray 35, a locking member 66 for preventing the movement of the connecting rod 65 is provided. The locking member 66 is provided with a horizontal shaft 66*a* projecting toward the connecting rod 65. The horizontal shaft 66*a* is engaged in a locking groove 65*c* provided to the connecting rod 65, so that the movement of the connecting rod 65 in the front-rear direction is prevented. Here, the stopper 62R, the connecting rod 65, and the cover push-up member 68 constitute an interrelating means for interrelating the operation of the releasing lever 61 with the opening and closing operation of the drum cover 58.

Figure 16A:
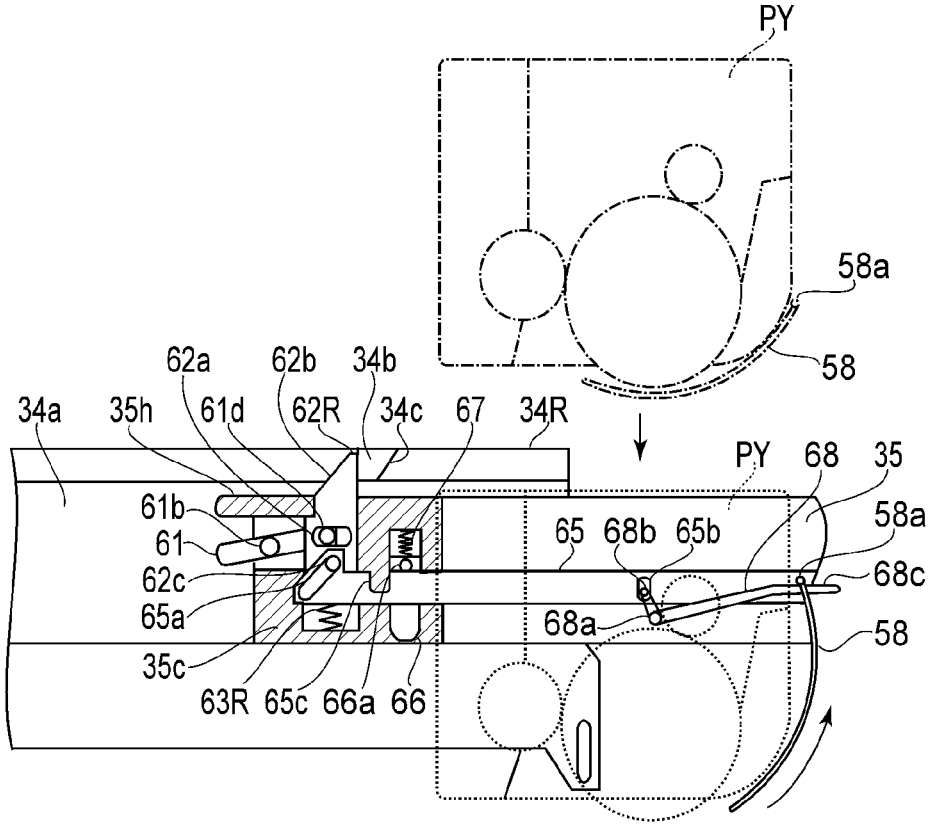
FIGS. 16A to 16D are schematic views for illustrating an opening/closing operation of a drum cover of the cartridge in Embodiment 1.

FIGS. 16A to 16D are schematic views for illustrating the opening and closing operation of the drum cover 58 of each cartridge when the cartridge is inserted into the tray 35 or when the tray 35 is disengaged from the apparatus main assembly. FIG. 16A is a schematic view showing a state in which the tray 35 shown in FIGS. 5 and 6 is pulled out to the pulled-out position.

The drum cover 58 is urged by an urging means (not shown) so as to be placed in the closed state. For this reason, in the state in which the cartridge is not inserted into the tray 35, as shown in FIG. 16A by a chain line, the drum cover 58 is located under the drum 1 to protect the surface of the drum 1. When the cartridge is inserted from above the tray 35, a projection 58*a* provided to the drum cover 58 runs against the arm 68*c* of the cover push-up member 68 to be pushed upward. As a result, the drum cover 58 is placed in the open state in which it is rotated in the counterclockwise direction to expose the drum 1.

Figure 16B:
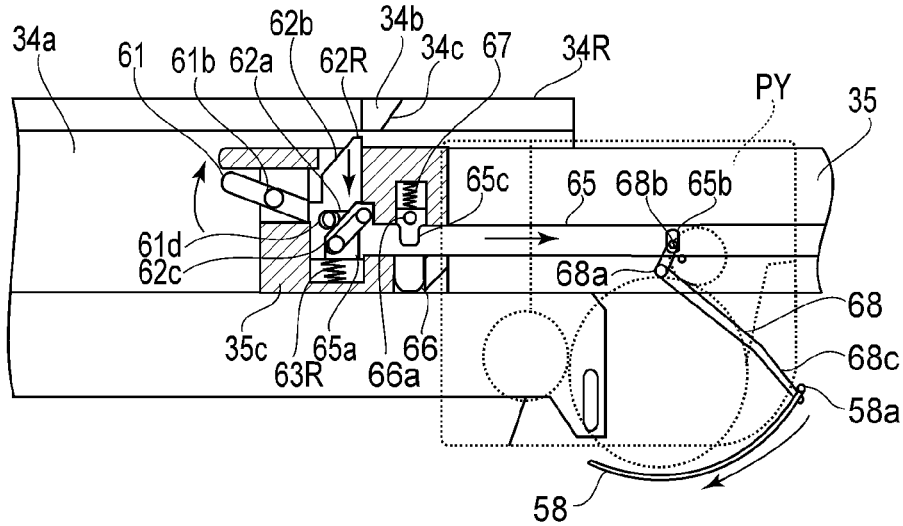

FIG. 16B is a schematic view showing a state in which the user holds the releasing lever 61 to retract the stopper 62R to the inside of the tray 35.

The horizontal shaft 62*c* provided to the stopper 62R engages with the inclined cam groove 65*a* provided at the rear end portion of the connecting rod 65. For this reason, when the stopper 62R moves downward, the connecting rod 65 moves in the apparatus main assembly front direction. The horizontal shaft 68*b* of the cover push-up member 68 is engaged with the vertical hole 65*b* provided to the connecting rod 65, so that when the connecting rod 65 is moved in the front direction, the cover push-up member 68 is rotated in the clockwise direction about the rotation shaft 68*a*. For this reason, the arm 68*c* which has pushed up the drum cover 58 is lowered, so that the drum cover 58 is placed in the closed state. At this time, the locking groove 65*c* provided to the connecting rod 65 is moved below the horizontal shaft 66*a* provided to the locking member 66. The locking member 66 is urged downward by an urging member but runs against the tray holding member 34R, so that the locking member 66 is not moved downward. As a result, the connecting rod 65 is in a state in which it is not locked.

Figure 16C:
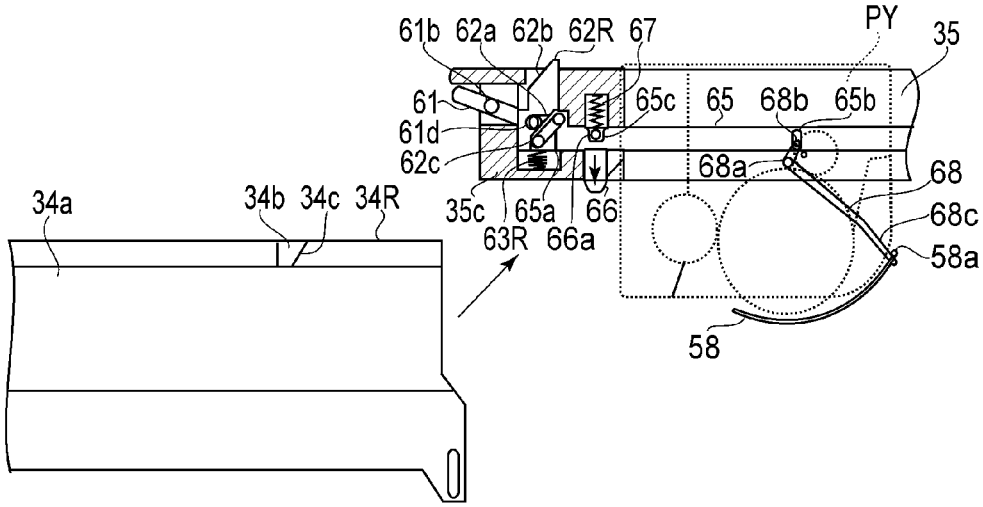
Figure 16D:
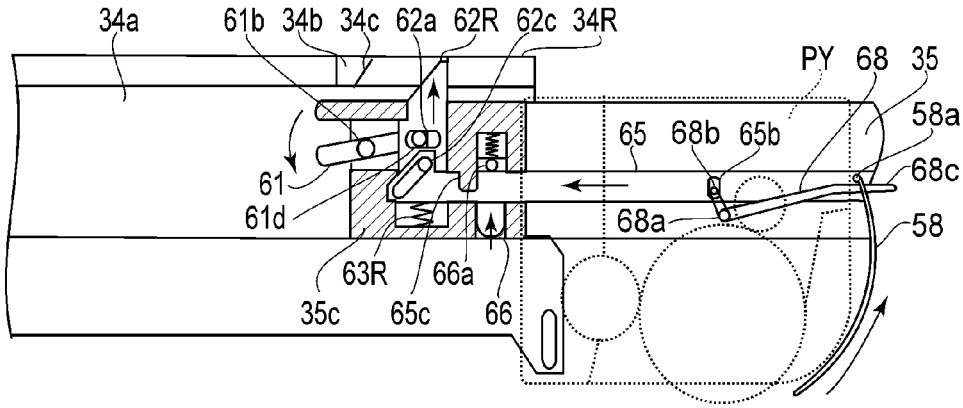

FIG. 16C is a schematic view showing a state in which the tray 35 is disengaged from the apparatus main assembly.

The tray 35 is moved away from the tray holding member 34R, so that the locking member 66 is moved downward with respect to the tray 35 to engage the horizontal shaft 66*a* with the locking groove 65*c* of the connecting rod 65. For this reason, the movement of the connecting rod 65 in the front-rear direction is prevented, so that the drum cover 58 is kept in the closed state even when the user moves his (her) hand(s) off the releasing lever 61.

FIG. 16(*d*) is a schematic view for illustrating the case where the disengaged tray 35 is mounted in the apparatus main assembly again.

When the tray 35 in the state shown in FIG. 16(*c*) is engaged again in the guide groove portion 34*a* of the tray holding member 34R, the locking member 66 is pushed up, so that the movement prevention of the connecting rod 65 is released. Then, by the urging force of the spring 63R for urging the stopper 62R upward, the connecting rod 65 is moved toward the rear side of the apparatus main assembly. For this reason, the cover push-up member 68 is rotated in the counterclockwise direction in FIG. 16(*d*), so that the drum cover 58 is pushed up to be placed in the open state.

In this embodiment, the drum cover 58 is provided to the cartridge but may also be configured to cover the drum 1 by being provided to the partitioning plate 35*f* so as to be interrelated with the operation of the releasing lever 61.

As described above, when the tray 35 is disengaged from the apparatus main assembly, the user is required to perform the operation in which the user pulls out the tray 35 toward the apparatus main assembly front direction while handling the handle portion 35*a* of the front frame 35*b* of the tray 35 and the rear handle portion 35*h* of the rear frame 35*c* at the same time. For this reason, the tray 35 is not disengaged with no user's intention and is disengaged from the apparatus main assembly while the user supports the tray 35 with both hands with reliability when the user intends to disengage the tray 35.

As described above, according to this embodiment, even when the user of the image forming apparatus pulls out the tray 35 for the cartridge exchange, the tray 35 is not disengaged from the apparatus main assembly until the user operates a prevention release operating portion.

Further, the tray 35 can be disengaged from the apparatus main assembly easily by such a simple operation that the user operates the prevention release operating portion and can also be held by the user with reliability by handling of the prevention release operating portion.

Therefore, it becomes possible to prevent an occurrence of the inconvenience to the tray 35 or the cartridge caused due to the unintentional disengagement of the tray 35 from the apparatus main assembly.

As a result, operativity of the maintenance such as the cartridge exchange or the jam clearance for removing the recording material remaining inside the apparatus main assembly can be improved.

Further, in interrelation with the disengaging operation of the tray 35 from the apparatus main assembly, the drum cover 58 can be automatically placed in the drum 1 protecting state. For this reason, even in the case where the tray 35 is disengaged, the drum surface is not damaged or contaminated. Therefore, the image quality is not impaired due to the damage or the contamination of the drum surface.

Embodiment 2

The image forming apparatus according to Embodiment 2 of the present invention will be described.

The constitution of the image forming apparatus in this embodiment is identical to that in Embodiment 1 except that the constitution of the tray 35 are the disengaging method of the tray 35 from the apparatus main assembly are different from those in Embodiment 1. Therefore, in this embodiment, only the differences, i.e., the constitution of the tray 35 and the disengaging method of the tray 35 from the apparatus main assembly will be described and thus the constitution identical to that in Embodiment 1 will be omitted from description.

Figure 19:
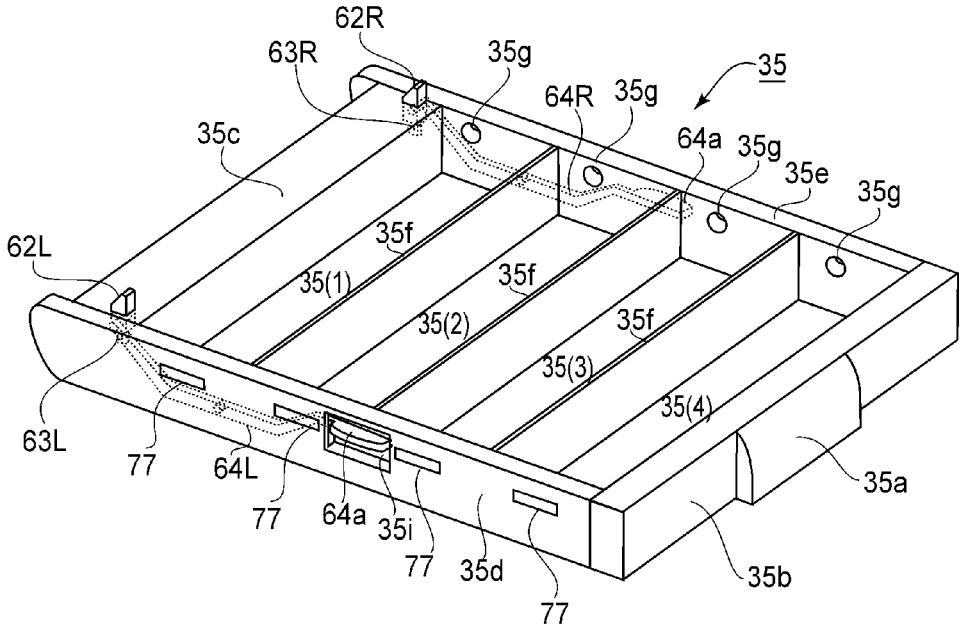
FIG. 19 is a perspective view of an outer appearance of a tray in Embodiment 2.

FIG. 19 is a schematic perspective view showing an outer appearance of the tray 35 in this embodiment.

The left and right frames 35*d* and 35*e* of the tray 35 are provided with releasing levers 64L and 64R, respectively.

The difference of this embodiment from Embodiment 1 is that an operating portion for releasing the prevention of the movement of the tray 35 in the pulling out direction by retracting the stoppers 62L and 62R to the inside of the tray 35 when the recording material remains inside the apparatus main assembly is provided to each of the left and right frames 35*d* and 35*e* of the tray 35. Other constitutions are identical to those in Embodiment 1.

Figure 20:
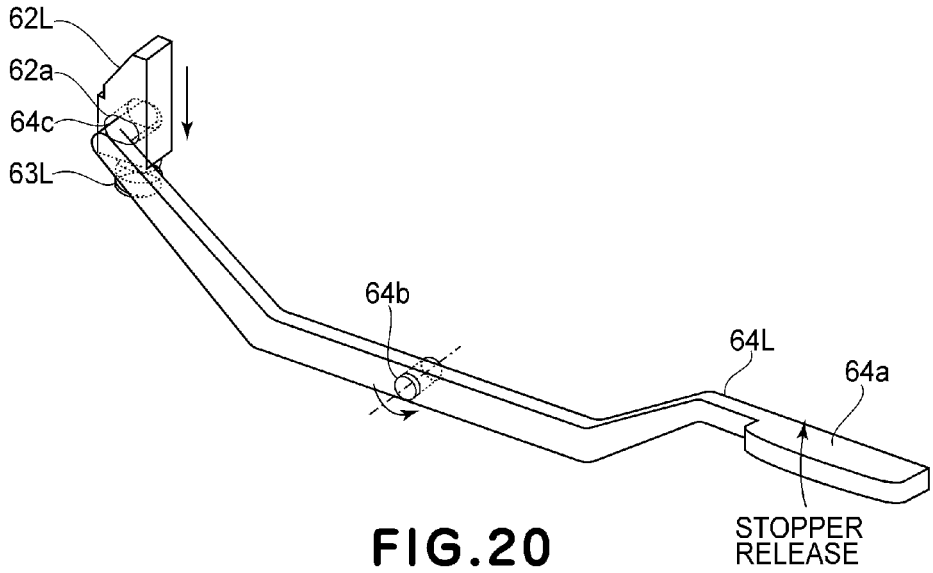
FIG. 20 is a perspective view showing a schematic structure of a connecting mechanism portion between a releasing lever and a stopper in Embodiment 2.

FIG. 20 is a perspective view showing a schematic structure of an interrelating mechanism portion of the releasing lever 64L with the stopper 62L. Hereinbelow, the interrelating mechanism portion provided to the left frame 35*d* of the tray 35 will be described but the other interrelating mechanism portion of the right frame 35*e* including the releasing lever 64R and the stopper 62R has the same constitution (function).

The releasing lever 64L is shaft-supported inside the left frame 35*d* so as to be rotatable about a rotation shaft 64*b*. To an apparatus main assembly front-side end of the releasing lever 64L, the operating portion 64*a* to be touched by the user is provided. The operating portion 64*a* is exposed from an opening 35*i* provided to the left frame 35*d* of the tray 35 toward the outside of the tray 35. At an apparatus main assembly rear-side end portion of the releasing lever 64L, a horizontal shaft 64*c* is formed to project toward the inside of the tray 35.

The stopper 62L is supported so as to be slidable in the vertical direction with respect to the rear frame 35*c* of the tray 35. The stopper 62L is provided with a horizontal elongated hole 62*a*. The horizontal shaft 64*c* of the releasing lever 64L is engaged in the elongated hole 62*a* of the stopper 61L.

As a result, when the releasing lever 64L is rotated about the rotation shaft 64*b* in the direction indicated by an arrow shown in FIG. 20, the stopper 62L is moved downward along the grooves provided to the rear frame 35 of the tray 35, thus being retracted to a position in which they doe not contact the locking portion 34*b* of the tray holding member 34L. That is, the user handles the operating portion 64*a* of the releasing lever 64L, so that the releasing lever 64L is rotated about the rotation shaft 64*b* in the direction indicated by the arrow shown in FIG. 20. As a result, the stopper 62L is retracted to the position in which it does not contact the locking portion 34*b* of the tray holding member 34L.

Further, the stoppers 62L and 62R are urged by springs 63L and 63R, respectively, from a lower side toward an upper side. For this reason, when the user moves his (her) hand off the operating portions 61*a* of the releasing levers 64L and 64R, the stoppers 62L and 62R are moved upwardly, so that the releasing levers 64L and 64R are rotated in a direction opposite from the direction indicated by the arrow shown in FIG. 20. Then, the releasing levers 64L and 64R and the stoppers 62L and 62R are returned to the original position, so that the stoppers 62L and 62R are in a state in which they contact the locking portions 34*b* of the tray holding members 34L and 34R.

When the tray 35 is disengaged from the apparatus main assembly in order to remove the recording material remaining in the apparatus main assembly, first, the user pulls out the tray 35 to the cartridge exchange position. In this state, the user holds the releasing levers 64L and 64R provided to the left and right frames 35*d* and 35*e* of the tray 35 and pushes upward the releasing levers 64L and 64R by putting his (her) fingers on the operating portions 64*a*. As a result, as described above, the stoppers 62L and 62R are retracted to the position in which they do not contact the locking portions 34*b* of the tray holding members 34L and 34R, so that the tray 35 can be disengaged from the apparatus main assembly by being further pulled out toward the apparatus main assembly front direction.

As described above, when the tray 35 is disengaged from the apparatus main assembly, the user is required to perform the operation in which the user pulls out the tray 35 in the direction of the apparatus main assembly front surface while simultaneously holding the operating portions 64*a* of the releasing levers 64L and 64R provided to the left and right frames 35*d* and 35*e* of the tray 35. For this reason, the tray 35 is not disengaged with no user's intention and is disengaged from the apparatus main assembly while the user supports the tray 35 with both hands with reliability when the user intends to disengage the tray 35.

Therefore, also in this embodiment, similarly to the case of Embodiment 1, it becomes possible to prevent an occurrence of the inconvenience to the tray 35 or the cartridge caused due to the drop of the tray 35.

The operation for returning the disengaged tray 35 into the apparatus main assembly is similar to that in Embodiment 1, so that the user is only required to slide the tray 35 in the apparatus main assembly rear direction along the guide groove portions 34*b* provided inside the tray holding members 34L and 34R and extending in the front-rear direction. That is, in the case where the disengaged tray 35 is returned into the apparatus main assembly, there is no need to operate the releasing levers 64L and 64R.

In this embodiment, the connection of the operating portion with the stopper by the user is performed by using the link mechanism but the present invention is not limited thereto. It is also possible to employ another mechanism such as a cam or a rack and pinion mechanism.

Further, the operating portion for releasing the stopper is provided on both (left and right) sides of the tray 35 (at both end portions with respect to a direction perpendicular to the movement direction of the tray 35 moving from the latent image forming position (the inside position) to the pulled-out position (the outside position) but may also be provided either one of the left and right sides.

In this embodiment, description about the connection between the releasing levers and the drum covers is emitted but similarly as in Embodiment 1, also in this embodiment, it is possible to automatically place the drum cover 58 in the closed state in interrelation with the operation of the releasing levers 64L and 64R.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 296014/2008 filed Nov. 19, 2008, which is hereby incorporated by reference.

What is claimed is:

1. An electrophotographic image forming apparatus comprising:

an electrophotographic image forming apparatus main assembly including a preventing portion;

a supporting member for supporting a plurality of electrophotographic photosensitive members, said supporting member being movable between an inside position inside said main assembly and an outside position outside said main assembly in a state in which said supporting member is supported by said main assembly, and being disengageable from said main assembly at the outside position;

a handle portion, provided to said supporting member, to be touched for disengaging said supporting member from said main assembly, said handle portion being provided upstream of the plurality of electrophotographic photosensitive members with respect a movement direction in which said supporting member is moved from the inside position to the outside position; and a portion to be prevented, provided to said supporting member, being movable between a preventing position in which said portion to be prevented contacts said preventing portion in order to prevent said supporting member from being disengaged from said main assembly, and a retracted position in which said portion to be prevented is retracted from the preventing position in order to disengage said supporting member from said main assembly, wherein said portion to be prevented is moved from the preventing position to the retracted position by the touch of said handle portion.

2. An apparatus according to claim 1, wherein said handle portion is located at a position in which a user cannot touch said handle portion in a state in which said supporting member is located at the inside position, and is located at a position in which the user can touch said handle portion in a state in which said supporting member is located at the outside position.

3. An apparatus according to claim 1, further comprising an urging member for urging said portion to be prevented from the retracted position toward the preventing position, wherein said portion to be prevented is moved from the preventing position to the retracted position against an urging force by the touch of said handle portion.

4. An apparatus according to claim 3, wherein said supporting member includes a contact portion at which said supporting member contacts said main assembly to move said portion to be prevented from the preventing position to the retracted position, and wherein when said supporting member is mounted at the outside position, said portion to be prevented is moved from the preventing position to the retracted position against the urging force by contact of said contact portion with said main assembly and then is restored from the retracted position to the preventing position by the urging force after said portion to be prevented passes through said preventing portion in a state in which said portion to be prevented is located at the retracted position.

5. An apparatus according to claim 1, wherein said supporting member includes another handle portion to be touched for moving said supporting member from the inside position to the outside position.

6. An apparatus according to claim 5, wherein said another handle portion is provided downstream of said supporting member with respect to the movement direction, and wherein said handle portion and said another handle portion are touched for disengaging said supporting member from said main assembly.

7. An apparatus according to claim 6, wherein said another handle portion is provided downstream of the plurality of electrophotographic photosensitive members with respect to the movement direction.

8. An apparatus according to claim 1, further comprising a cover member for protecting an exposed portion of the plurality of electrophotographic photosensitive members exposed from said supporting member, said cover member being capable of covering and uncovering the exposed portion, wherein said cover member is changed from an open state to a closed state by the touch of said handle portion.

9. An apparatus according to claim 8, wherein said supporting member includes said cover member.

10. A supporting member for supporting a plurality of electrophotographic photosensitive members, said supporting members being movable between an inside position inside an electrophotographic image forming apparatus main assembly including a preventing portion, and an outside position outside the main assembly in a state in which said supporting member is supported by the main assembly and being disengageable from the main assembly at the outside position, said supporting member comprising:

a handle portion to be touched for disengaging said supporting member from the main assembly, said handle portion being provided upstream of the plurality of electrophotographic photosensitive members with respect a movement direction in which said supporting member is moved from the inside position to the outside position; and a portion to be prevented being movable between a preventing position in which said portion to be prevented contacts the preventing portion in order to prevent said supporting member from being disengaged from the main assembly and a retracted position in which said portion to be prevented is retracted from the preventing position in order to disengage said supporting member from the main assembly, said portion to be prevented being moved from the preventing position to the retracted position by the touch of said handle portion.

11. A supporting member according to claim 10, wherein said handle portion is located at a position in which a user cannot touch said handle portion in a state in which said supporting member is located at the inside position, and is located at a position in which the user can touch said handle portion in a state in which said supporting member is located at the outside position.

12. A supporting member according to claim 10, further comprising an urging member for urging said portion to be prevented from the retracted position toward the preventing position, wherein said portion to be prevented is moved from the preventing position to the retracted position against an urging force by the touch of said handle portion.

13. A supporting member according to claim 12, wherein said supporting member includes a contact portion at which said supporting member contacts the main assembly to move said portion to be prevented from the preventing position to the retracted position, and wherein when said supporting member is mounted at the outside position, said portion to be prevented is moved from the preventing position to the retracted position against the urging force by contact of said contact portion with the main assembly and then is restored from the retracted position to the preventing position by the urging force after said portion to be prevented passes through the preventing portion in a state in which said portion to be prevented is located at the retracted position.

14. A supporting member according to claim 10, wherein said supporting member includes another handle portion to be touched for moving the supporting member from the inside position to the outside position.

15. A supporting member according to claim 14, wherein said another handle portion is provided downstream of said supporting member with respect to the movement direction, and wherein said handle portion and said another handle portion are touched for disengaging said supporting member from said main assembly.

16. A supporting member according to claim 15, wherein said another handle portion is provided downstream of the plurality of electrophotographic photosensitive members with respect to the movement direction.

17. A supporting member according to claim 10, further comprising a cover member for protecting an exposed portion of the plurality of electrophotographic photosensitive members exposed from said supporting member, said cover member being capable of covering and uncovering the exposed portion, wherein said cover member is changed from an open state to a closed state by the touch of said handle portion.

18. An electrophotographic image forming apparatus comprising:

an electrophotographic image forming apparatus main assembly including a preventing portion;

a supporting member for supporting a plurality of electrophotographic photosensitive members, said supporting member being movable between an inside position inside said main assembly, and an outside position outside said main assembly in a state in which said supporting member is supported by said main assembly and being disengageable from said main assembly at the outside position;

a first handle portion, provided to said supporting member, to be touched for disengaging said supporting member from said main assembly, wherein said first handle portion is provided upstream of the plurality of electrophotographic photosensitive members with respect to a movement direction in which said supporting member is moved from the inside position to the outside position;

a second handle portion, provided to said supporting member, to be touched for moving said supporting member from the inside position to the outside position; and a portion to be prevented, provided to said supporting member, being movable between a preventing position in which said portion to be prevented contacts said preventing portion in order to prevent said supporting member from being disengaged from said main assembly, and a retracted position in which said portion to be prevented is retracted from the preventing position in order to disengage said supporting member from said main assembly.

19. An apparatus according to claim 18, wherein said first handle portion is located at a position in which a user cannot touch said handle portion in a state in which said supporting member is located at the inside position, and is located at a position in which the user can touch said first handle portion in a state in which said supporting member is located at the outside position.

20. An apparatus according to claim 18, wherein said first handle portion and said second handle portion are touched for disengaging said supporting member from said main assembly.

21. An apparatus according to claim 18, wherein said second handle portion is provided downstream of the plurality of electrophotographic photosensitive members with respect to the movement direction.

22. A supporting member for supporting a plurality of electrophotographic photosensitive members, said supporting member being movable between an inside position inside an electrophotographic image forming apparatus main assembly including a preventing portion, and an outside position outside the main assembly in a state in which said supporting member is supported by the main assembly and being disengageable from the main assembly at the outside position, said supporting member comprising:

a first handle portion to be touched for disengaging said supporting member from the main assembly, wherein said first handle portion is provided upstream of the plurality of electrophotographic photosensitive members with respect to a movement direction in which said supporting member is moved from the inside position to the outside position;

second handle portion, provided to said supporting member, to be touched for moving the supporting member from the inside position to the outside position; and a portion to be prevented being movable between a preventing position in which said portion to be prevented contacts the preventing portion in order to prevent said supporting member from being disengaged from the main assembly, and a retracted position in which said portion to be prevented is retracted from the preventing position in order to disengage said supporting member from the main assembly.

23. A supporting member according to claim 22, wherein said first handle portion is located at a position in which a user cannot touch said handle portion in a state in which said supporting member is located at the inside position, and is located at a position in which the user can touch said handle portion in a state in which said supporting member is located at the outside position.

24. A supporting member according to claim 22, wherein said first handle portion and said second handle portion are touched for disengaging said supporting member from said main assembly.

25. A supporting member according to claim 22, wherein said second handle portion is provided downstream of the plurality of electrophotographic photosensitive members with respect to the movement direction.

* * * * *